US007494475B2

(12) United States Patent
Morita et al.

(10) Patent No.: US 7,494,475 B2
(45) Date of Patent: Feb. 24, 2009

(54) MASSAGE UNIT AND CHAIR HAVING PIVOTAL LEVER TO GRIP AND KNEAD

(75) Inventors: Yoshitoshi Morita, Nishiwaki (JP); Yuji Kan, Kasai (JP); Nobuaki Takahashi, Kasai (JP)

(73) Assignee: Sanyo Electric Company, Ltd., Osaka (JP)

( * ) Notice: Subject to any disclaimer, the term of this patent is extended or adjusted under 35 U.S.C. 154(b) by 488 days.

(21) Appl. No.: 11/065,594

(22) Filed: Feb. 24, 2005

(65) Prior Publication Data

US 2005/0192520 A1 Sep. 1, 2005

(30) Foreign Application Priority Data

Feb. 26, 2004 (JP) ..... 2004-051389

(51) Int. Cl.
*A61H 15/00* (2006.01)

(52) U.S. Cl. ..... 601/94; 601/102; 601/103; 601/116; 601/133

(58) Field of Classification Search ..... 601/86, 601/87, 90, 93–95, 97, 98, 99, 101–103, 601/106, 108, 110, 111, 116, 117, 133
See application file for complete search history.

(56) References Cited

U.S. PATENT DOCUMENTS 6,511,448 B1 1/2003 Furiuie
6,790,190 B2 * 9/2004 Marcantoni ..... 601/99
6,899,688 B2 * 5/2005 Wu ..... 601/99

FOREIGN PATENT DOCUMENTS

| | | |
|---|---|---|
| EP | 1 145 700 A1 | 10/2001 |
| EP | 1 400 230 A1 | 3/2004 |
| JP | 09-313559 | 12/1997 |
| JP | 2002-233559 | 8/2002 |

* cited by examiner

*Primary Examiner*—Danton DeMille
(74) *Attorney, Agent, or Firm*—Eckert Seamans Cherin & Mellott, LLC; Carol A. Mamo, Esq.

(57) ABSTRACT

A pivotal lever has a first therapeutic member and a second therapeutic member positioned below the first member, for the members to grip and knead the shoulder of the person to be massaged as by the fingers of the acupressurist. A massage unit 20 comprises a pair of left and right pivotal levers 100 pivotally movably arranged on a chassis 21, and a first therapeutic member 200 and a second therapeutic member 300 arranged on each of the pivotal levers 100 and movable toward and away from each other. The first and second therapeutic members 200, 300 have motion conversion 400 coupled thereto for converting the pivotal movement of the pivotal lever 100 into the movement of the first and second therapeutic members 200, 300 toward and away from each other. The first and second therapeutic members 200, 300 grip the shoulder of the person when moved toward each other and release the shoulder from the gripping action when moved away from each other to thereby cause the members to simulate the gripping and kneading movement of the acupressurist.

3 Claims, 23 Drawing Sheets

MASSAGE UNIT AND CHAIR HAVING PIVOTAL LEVER TO GRIP AND KNEAD

TECHNICAL FIELD

The present invention relates to massage units comprising a first therapeutic member and a second therapeutic member which are movable toward and away from each other for gripping and kneading the shoulder of the person to be massaged, and massage machines of the chair type comprising the unit.

BACKGROUND ART

A massage machine has been proposed which comprises a first therapeutic member and a second therapeutic member which are driven by different drive sources and cooperative to knead the shoulder of the person to be massaged (publication of JP-A No. 9-313559).

Also proposed is a massage machine which comprises a pair of therapeutic members opposedly arranged at the left and the right, the therapeutic members being pivotally movable toward and away from each other to nip or rub the affected part (publication of JP-A No. 2002-233559).

The former massage machine has an increased number of drive sources and is costly. The first and second therapeutic members require a complex mode of control for the cooperative operation.

The latter massage machine is unable to perform a movement resembling that of the fingers of the acupressurist which grip and knead the shoulder of the person to be massaged.

DISCLOSURE OF THE INVENTION

An object of the present invention is provide a massage unit comprising a first therapeutic member and a second therapeutic member which are repeatedly moved toward and away from each other to thereby grip and knead the shoulder of the person to be massaged.

The present invention provides a massage unit comprising a first therapeutic member pivotally movably disposed on a chassis, drive means for pivotally moving the first therapeutic member, and a second therapeutic member pivotally movable in operative relation with the pivotal movement of the first therapeutic member so as to move toward and away from the first therapeutic member and cooperative with the first therapeutic member to grip and knead an affected part of the person to be massaged.

The massage unit is so set that the first and second therapeutic members are positioned for kneading the shoulder of the person to be massaged. When the first therapeutic member is pivotally moved by the drive means, the second therapeutic member is pivotally moved to move toward and away from the first therapeutic member repeatedly with the movement of the first member. The muscle of the shoulder is gripped when the two members are brought toward each other and released from the gripping members when the members are moved away from each other. This movement resembles the movement of the acupressurist to grip and knead the shoulder, producing a massage effect not available by the tapping movement or kneading movement of conventional massage machines.

When the first therapeutic member is driven for the pivotal movement, the second therapeutic member is pivotally moved with this movement. This eliminates the need for another drive source for driving the second therapeutic member, consequently simplifying the construction and reducing the manufacturing cost.

The present invention also provides a massage unit comprising a pair of left and right pivotal levers pivotally movably arranged on a chassis, and a first therapeutic member and a second therapeutic member arranged on each of the pivotal levers and movable toward and away from each other so as to grip and knead an affected part of the person to be massaged, the first therapeutic member and the second therapeutic member having motion conversion means coupled thereto for converting the pivotal movement of the pivotal lever into the movement of the first therapeutic member and the second therapeutic member toward and away from each other.

When the pivotal lever is pivotally moved, the first and second therapeutic members also pivotally move, permitting the motion conversion means to repeatedly move the two therapeutic members toward and away from each other on the pivotal lever. As a result, the muscle of the shoulder is gripped when the two members move toward each other and is released from the gripping action when the two members move away from each other.

Since the drive source for moving the first and second therapeutic members is the pivotal movement of the pivotal lever, there is no need to provide another drive source. The massage unit and the massage machine can therefore be simplified in construction and reduced in manufacturing cost.

The present invention provides a massage machine of the chair type comprising a backrest disposed in the rear of a seat for the person to be massaged to sit in, and a massage unit of the construction described above and reciprocatingly movable upward and downward along the backrest.

BEST MODE OF CARRYING OUT THE INVENTION

A description will be given of an embodiment of massage machine of the chair type having a massage unit of the present invention.

Figure 9:
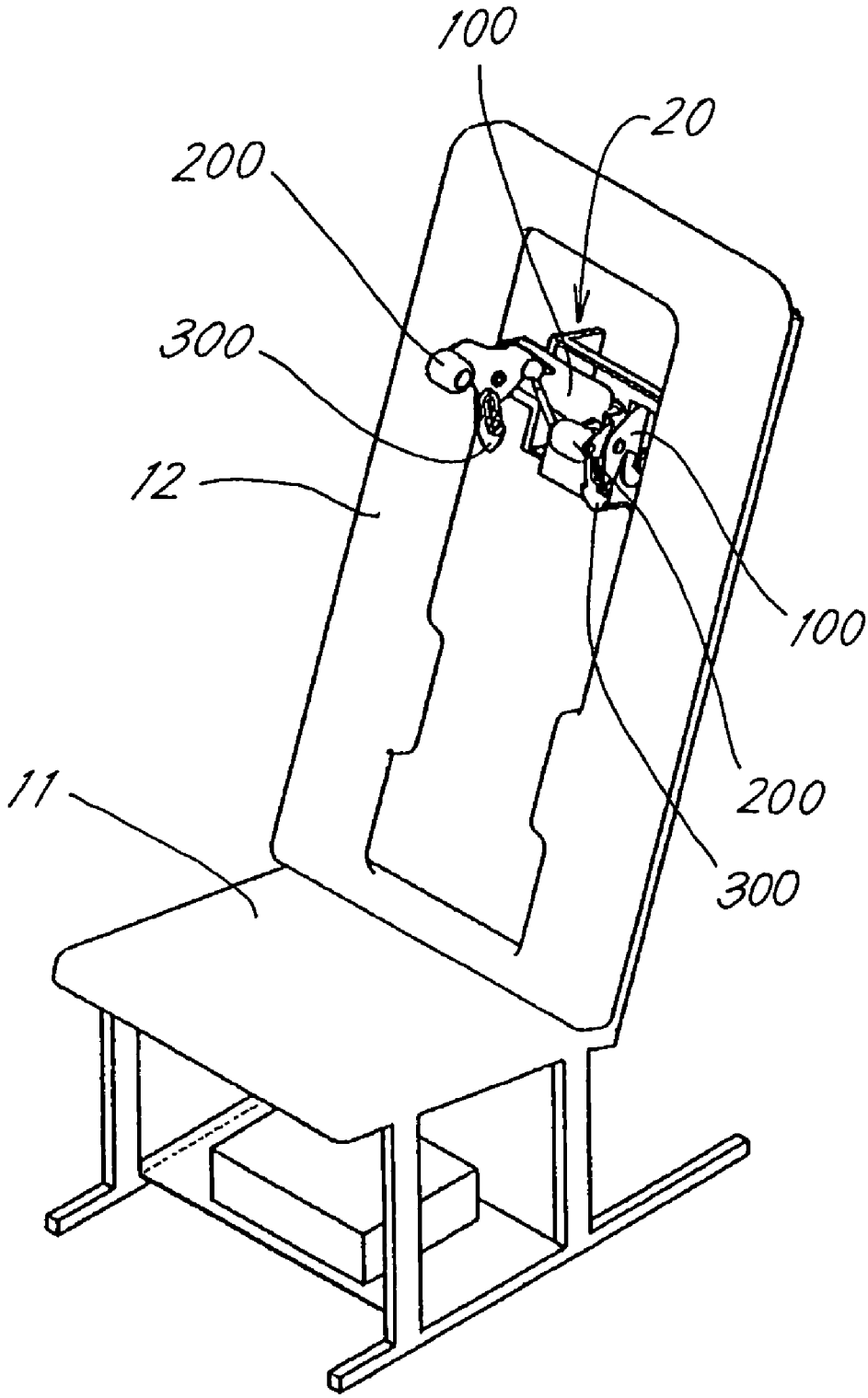
FIG. 9 is a schematic perspective view of a massage machine of the chair type.

With reference to FIG. 9, the massage machine of the chair type comprises a seat 11 for the person to be massaged to sit in, a backrest 12 connected to the rear end of the seat 11 as by a frame so as to be tiltable and positionable in place, and a massage unit 20 mounted on the backrest 12 upwardly and downwardly movably along an opening at the center of the backrest 12. The massage unit 20 is covered with a cloth, cushion or the like (not shown) provided over the backrest 12 but can be pushed out from inside the backrest 12 to the outer side thereof free of any trouble.

In the following description, the term "front" refers to the side toward which the massage unit moves toward the person to be massaged, and the term "rear" to the side away from the person. Further the term "left" is the left side of the massage machine and the term "right" to the right side thereof, as it is seen in facing relation therewith.

The massage unit 20 to be described below comprises a first therapeutic member 200 and a second therapeutic member 300 arranged on each of a pair of pivotal levers 100 arranged at the left and the right. The opposed pair of the first therapeutic members 200, 200, as well as the opposed pair of second therapeutic members 300, 300, are moved toward and away from each other to perform a kneading movement to nip from opposite sides the affected part of the person to be massaged, a tapping movement on the affected part mainly with the first therapeutic members 200, 200, and a movement comprising these movements in combination. However, these movements are of secondary importance, and the main feature of the present invention is that the massage unit is adapted to perform a kneading movement to grip the shoulder or the nape of the neck with the first and second therapeutic members 200, 300.

[Inside Construction of Backrest]

Figure 1:
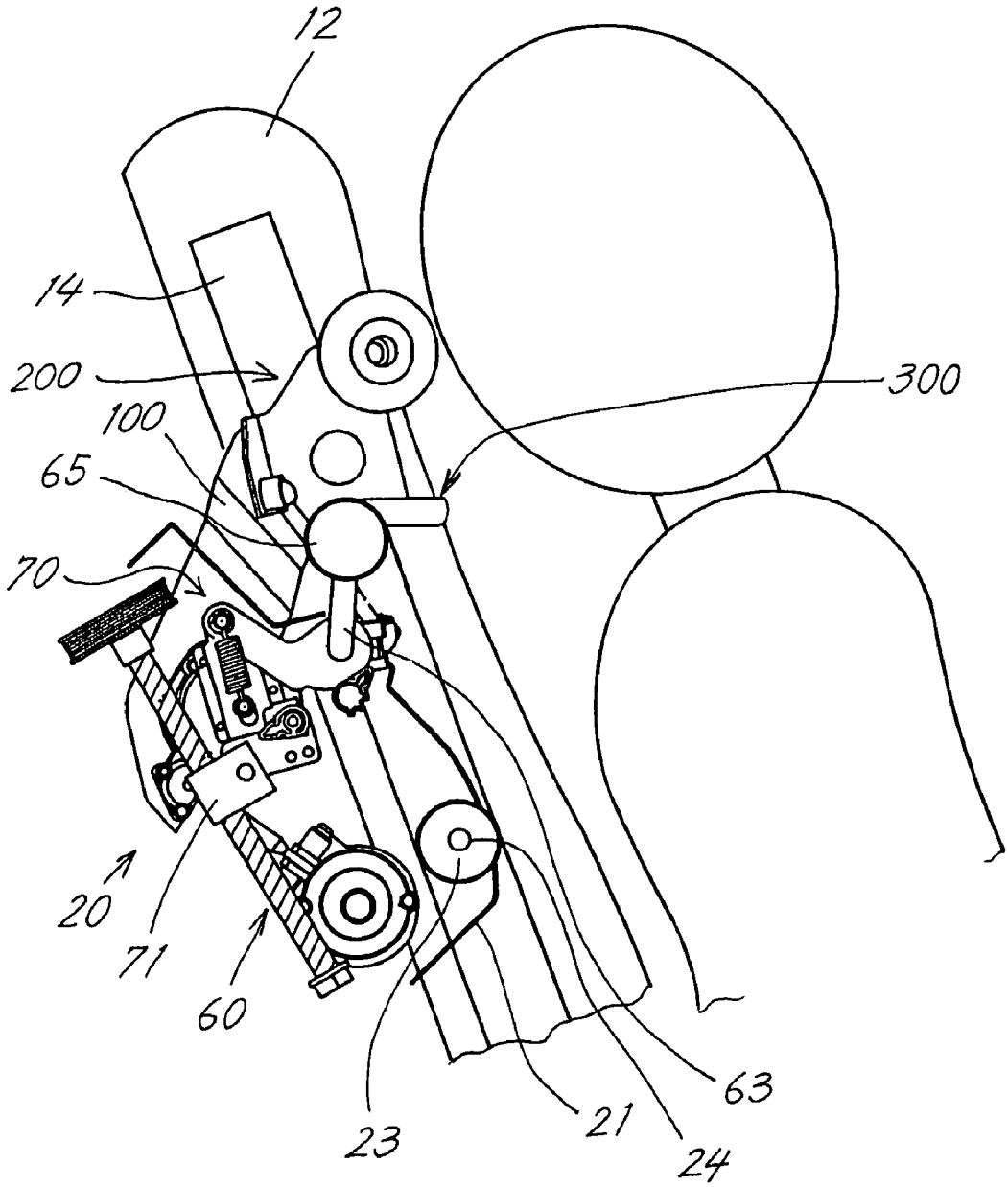
FIG. 1 is a sectional view showing a massage unit as accommodated in a backrest.
Figure 2:
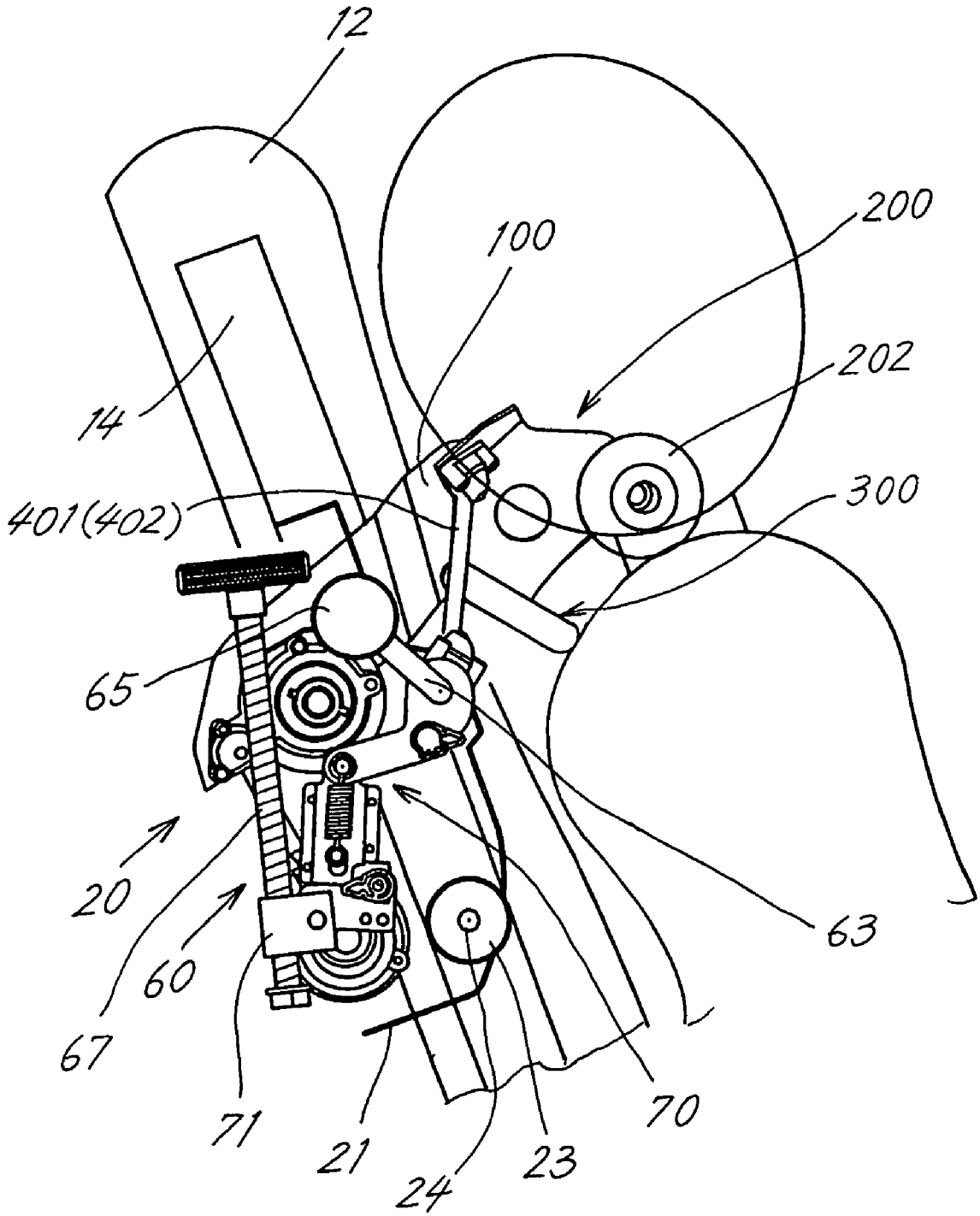
FIG. 2 is a sectional view showing the massage unit as pushed out forward.

With reference to FIGS. 1 and 2, the backrest 12 has inside thereof a pair of left and right guide rails 14 extending upward or downward in parallel. The guide rails 14, 14 are each U-shaped in cross section and are arranged with their grooves opposed to each other. One of the edges defining the groove of each rail is provided with a rack 16 (see FIG. 3). The massage unit 20 is upwardly and downwardly movably mounted on the guide rails 14, 14.

Figure 3:
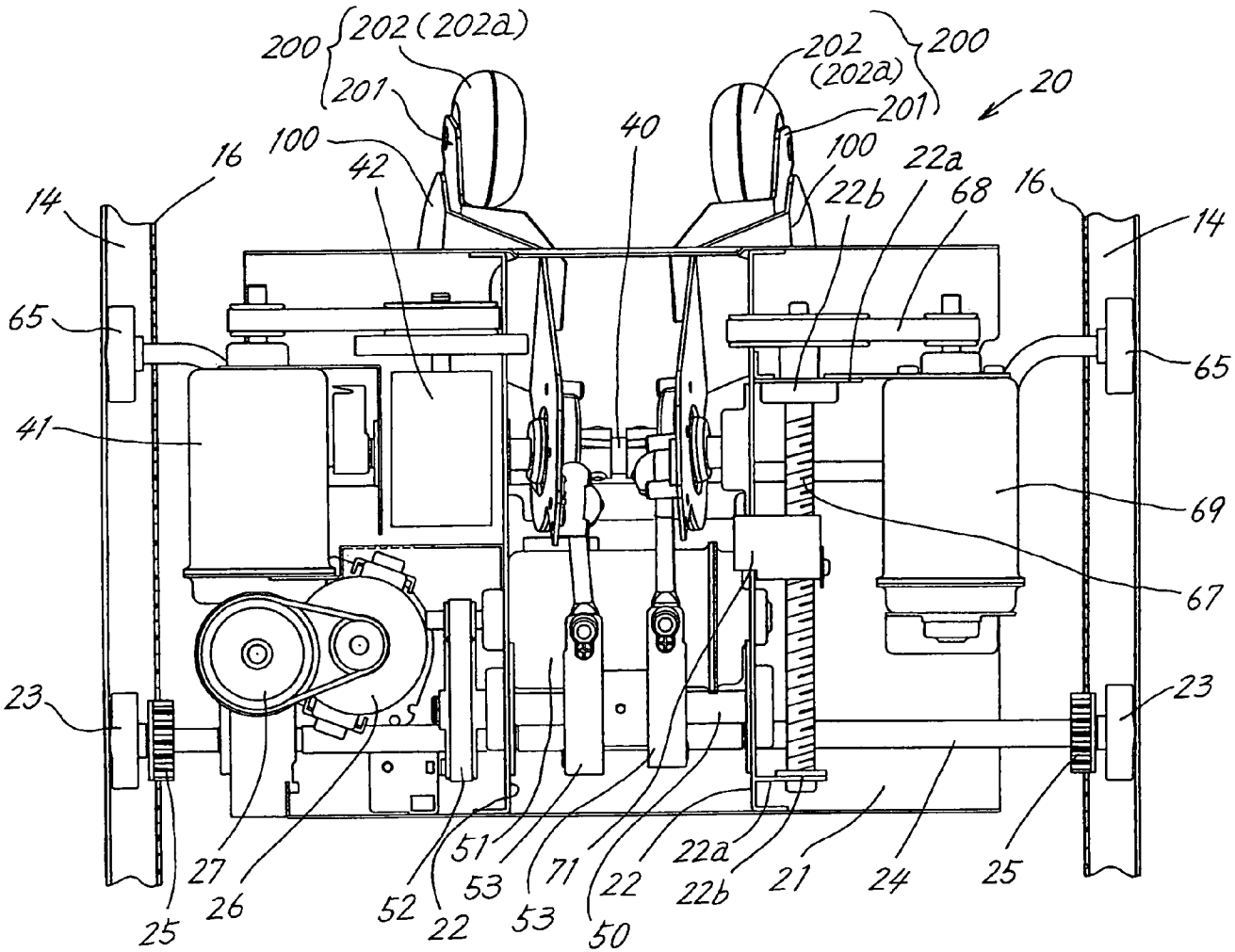
FIG. 3 is a rear view of the massage unit.

As shown in FIGS. 1 to 3, the massage unit 20 has four rollers 23, 23, 65, 65 projecting from upper and lower portions of a main chassis 21 and fitting in the guide rails 14, 14, whereby the unit 20 is made movable upward and downward. The main chassis 21 has all components of the massage unit 20 mounted thereon.

Figure 4:
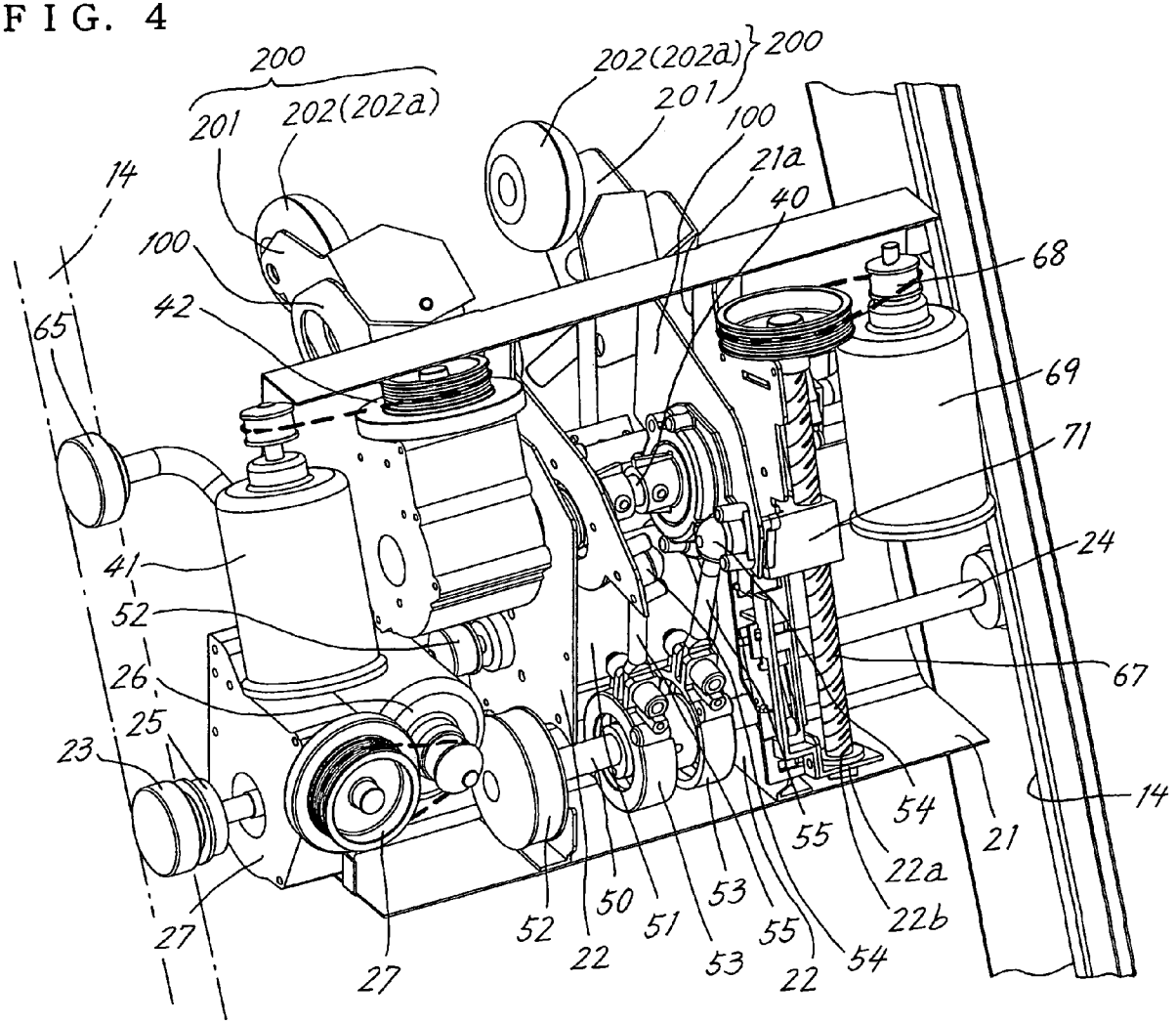
FIG. 4 is a perspective view of the massage unit as it is seen from obliquely rightwardly behind.

The main chassis 21 is fixedly provided at the center thereof with two auxiliary chassis 22, 22 spaced apart by a distance and extending vertically as shown in FIGS. 3 and 4.

A rotating shaft 24 for an upward-downward movement is rotatably horizontally supported by the auxiliary chassis 22, 22 at a lower portion of each chassis and has opposite ends extending to the respective guide rails 14. The shaft 24 is provided at each of its opposite ends with the roller 23, i.e., lower roller 23, rollable as fitted in the rail 14, and a gear 25 meshing with the rack 16 formed on the opening edge of the guide rail 14.

An up-down motor 26 for an upward-downward movement is mounted on the main chassis 21 and has an output shaft coupled to the rotating shaft 24 by reduction means 27. The motor 26 drivingly rotates the rotating shaft 24 to rotate the gears 25 and move the massage unit 20 upward or downward along the guide rails 14.

[Construction of Therapeutic Members and Kneading and Tapping Mechanism]

Figure 5:
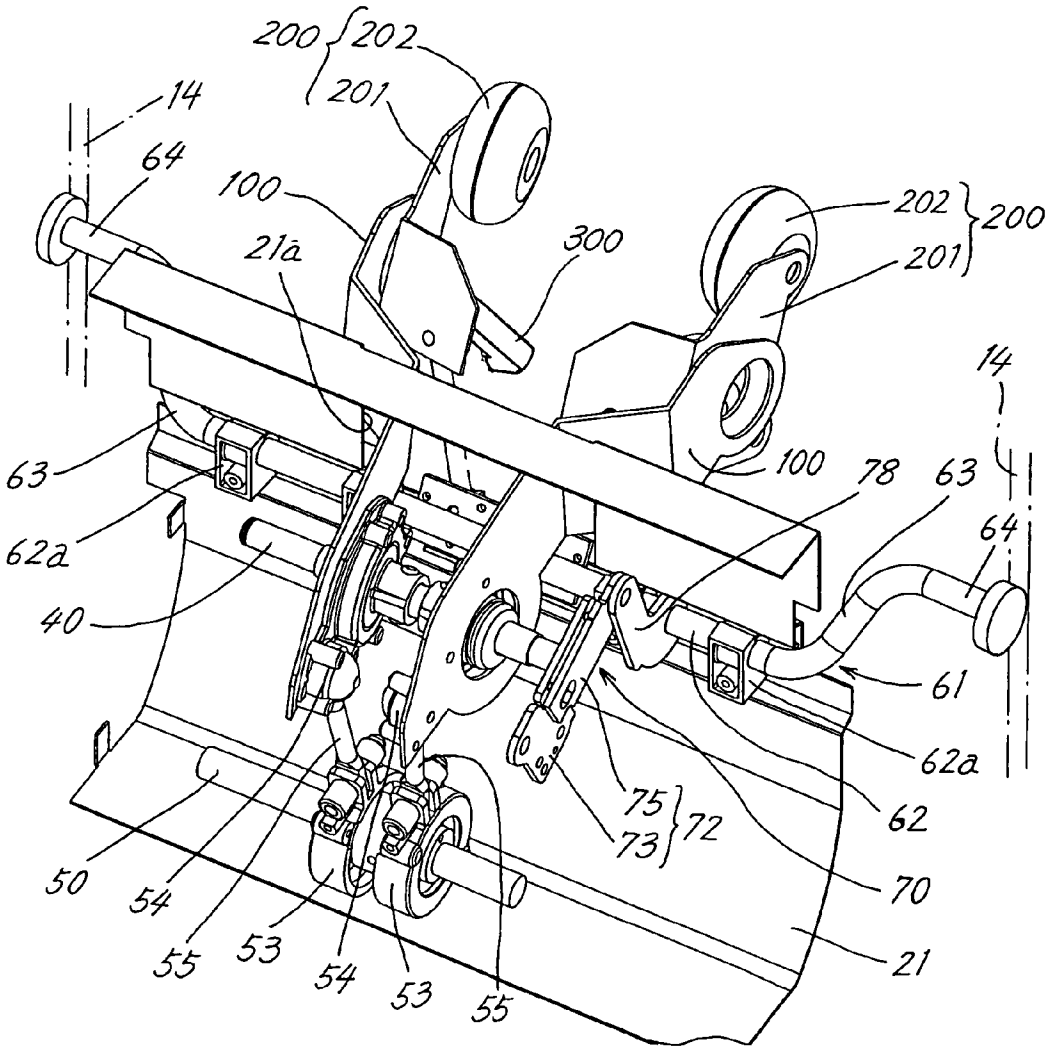
FIG. 5 is a fragmentary perspective view of the massage unit.

As shown in FIGS. 3 to 5, the first therapeutic member 200 and the second therapeutic member 300 are provided on each of the opposed pair of pivotal levers 100 connected to both a kneading shaft 40 supported by the approximate midportions of the auxiliary chassis 22, 22 and a tapping shaft 50 supported below the kneading shaft 40.

The kneading shaft 40 and the tapping shaft 50 are coupled to a kneading motor 41 and a tapping motor 51 mounted on the main chassis 21, by reduction means 42, 52, respectively.

Figure 10:
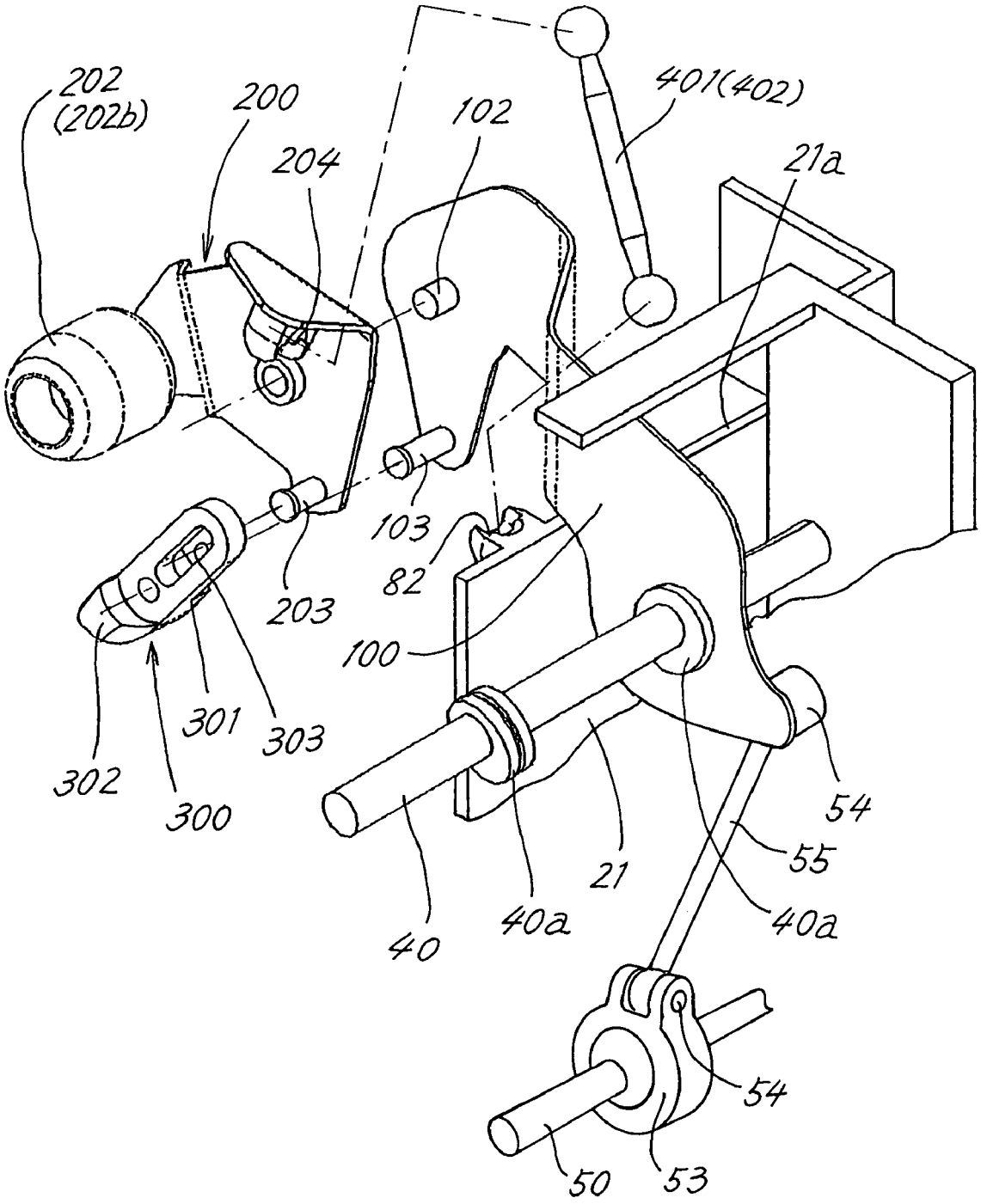
FIG. 10 is an exploded perspective view of a pivotal lever, first therapeutic member and second therapeutic member.

The pivotal levers 100 have their base portions rotatably fitted around and supported respectively by two eccentric output shaft portions 40*a*, 40*a* provided on the kneading shaft 40 and slanting in directions opposite to each other as shown in FIGS. 4, 5 and 10. The pivotal levers 100 extend forward, each at a portion thereof toward a free end (front end) thereof, through an aperture 21*a* in a front wall of the main chassis 21 while being bent laterally outward away from each other. Each pivotal lever 100 has its free end bent downward.

As shown in FIG. 10, the pivotal lever 100 has its rear end coupled by a rod 55 to an eccentric cam 53 on the tapping shaft 50 to be described below and is limited in its pivotal movement about the kneading shaft 40. More specifically, the free end of the lever 100 is limited in the ranges of pivotal movements in upward, downward, leftward and rightward directions.

Figure 11:
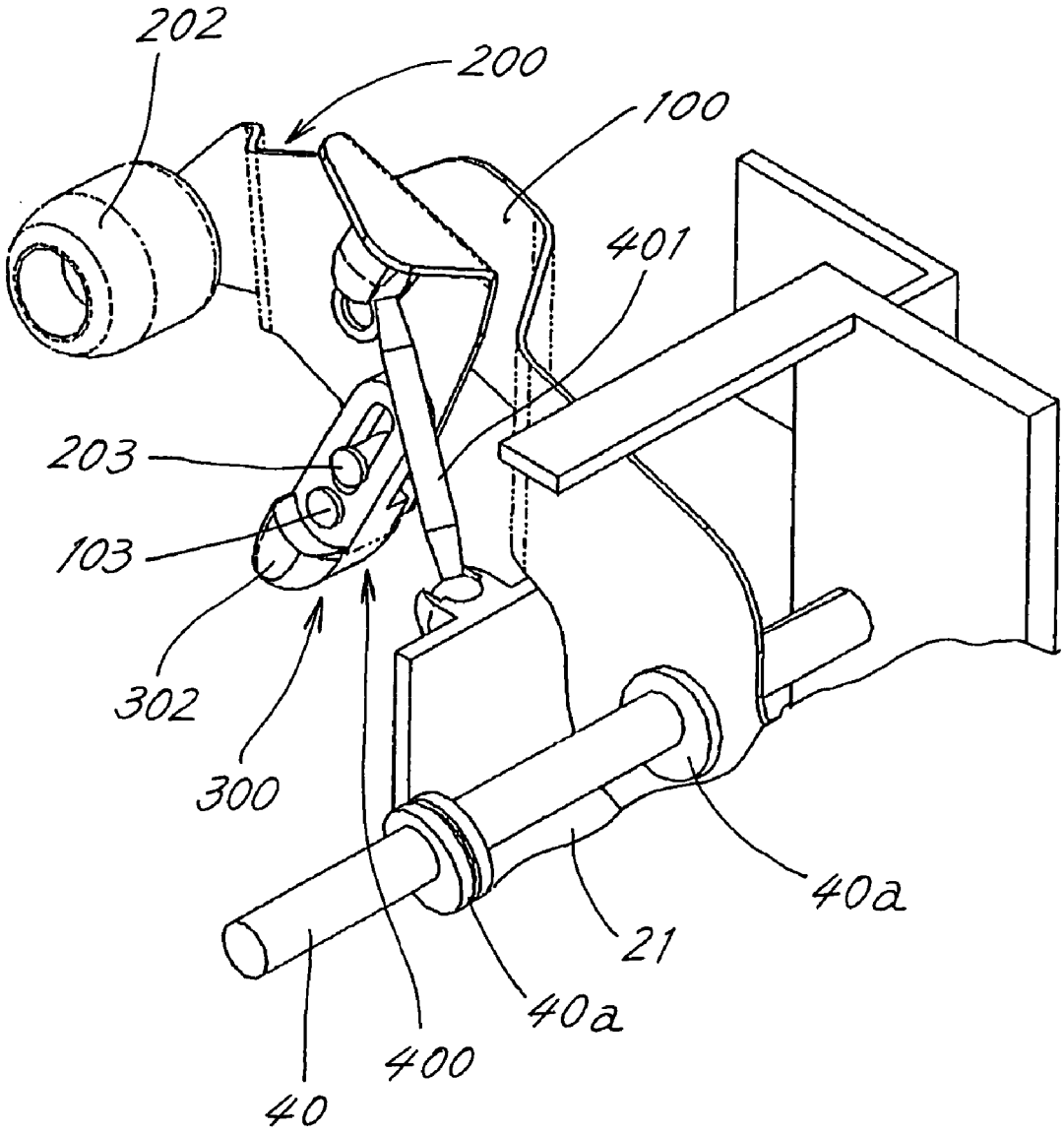
FIG. 11 is a perspective view of the pivotal lever, first therapeutic member and second therapeutic member as assembled.
Figure 12:
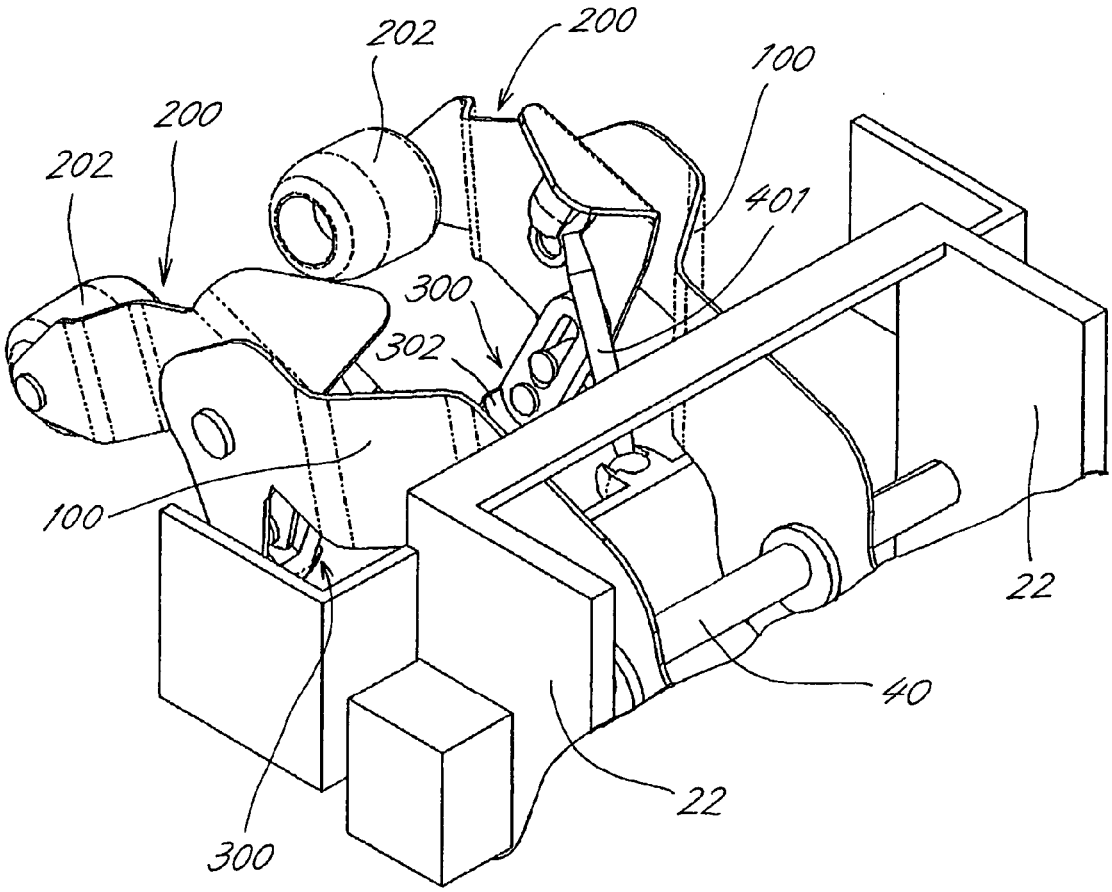
FIG. 12 is a perspective view of a pair of left and right pivotal levers as arranged on a chassis.

As shown in FIGS. 10 to 12, the first therapeutic member 200 and the second therapeutic member 300 are arranged respectively at an upper portion and a lower portion of the free end of the pivotal lever 100 so as to be pivotally movable within a plane along the plane of pivotal movement of the lever 100.

The first therapeutic member 200 comprises a first pivotal lever 201 and a pressure element 202 inwardly projecting from a free end of the lever 201. The first pivotal lever 201 is pivotably supported by a pivot 102 on the lever 100 to position the pressure element 202 forwardly of the lever 100.

The second therapeutic member 300 comprises a second pivotal lever 301 in the form of a bar and a pressure element 302 projecting inward from one end of the lever 301.

The second pivotal lever 301 is rotatably fitted approximately at the midportion thereof to a pin 103 provided on a front lower end of the pivotal lever 100, with the pressure element 302 positioned down.

The second pivotal lever 301 is provided in an upper portion thereof with an elongated hole 303, such as a hollow or slit, extending longitudinally of the lever, and a pin 203 provided on the first pivotal lever 201 is slidably fitted in the elongated hole 303. The two pressure members 202 and 302 are spaced apart by a sufficient distance so as to grip the muscle of the shoulder of the person to be massaged.

The pressure element 202 of the first therapeutic member 200 may be in the form of a flat roller 202*a* rotatably mounted on the first pivotal lever 201 as shown in FIG. 3, whereas the element 202 may alternatively be in the form of a roller 202*b* of increased width which is rotatably mounted on the lever 201 with the roller axis positioned laterally as seen in FIG. 10. The kneading effect to be produced by the roller 202*b* feels like that produced by the first finger (forefinger) to the fourth finger (little finger) of the acupressurist.

In order to make the second therapeutic member 300 feel like the thumb of the acupressurist when used for kneading, the lower end of the second pivotal lever 301 may have a small inward protuberance and thereby given nearly the same width as the thumb.

Figure 15:
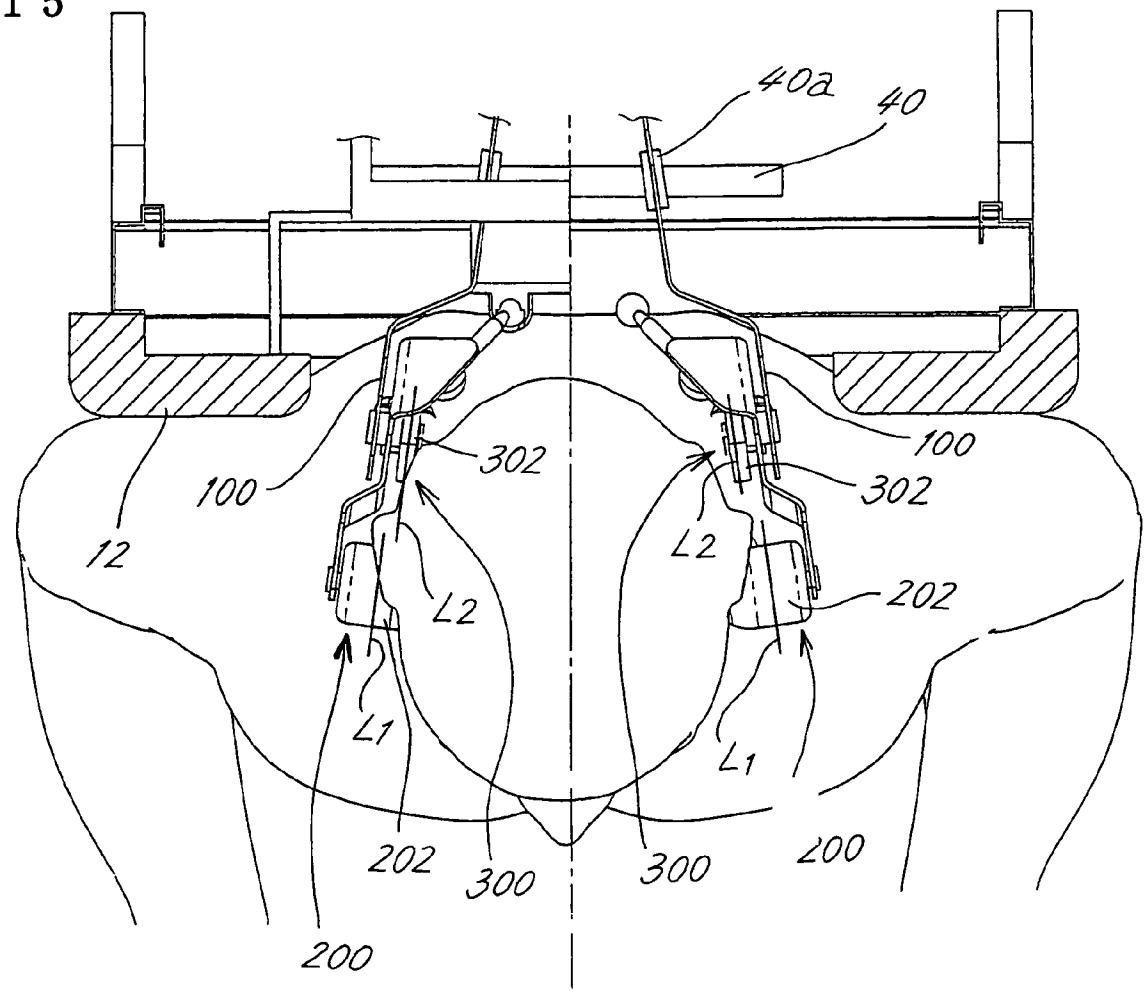
FIG. 15 is a plan view showing the opposed pair of pivotal levers of the first embodiment as they are moved away from each other.
Figure 16:
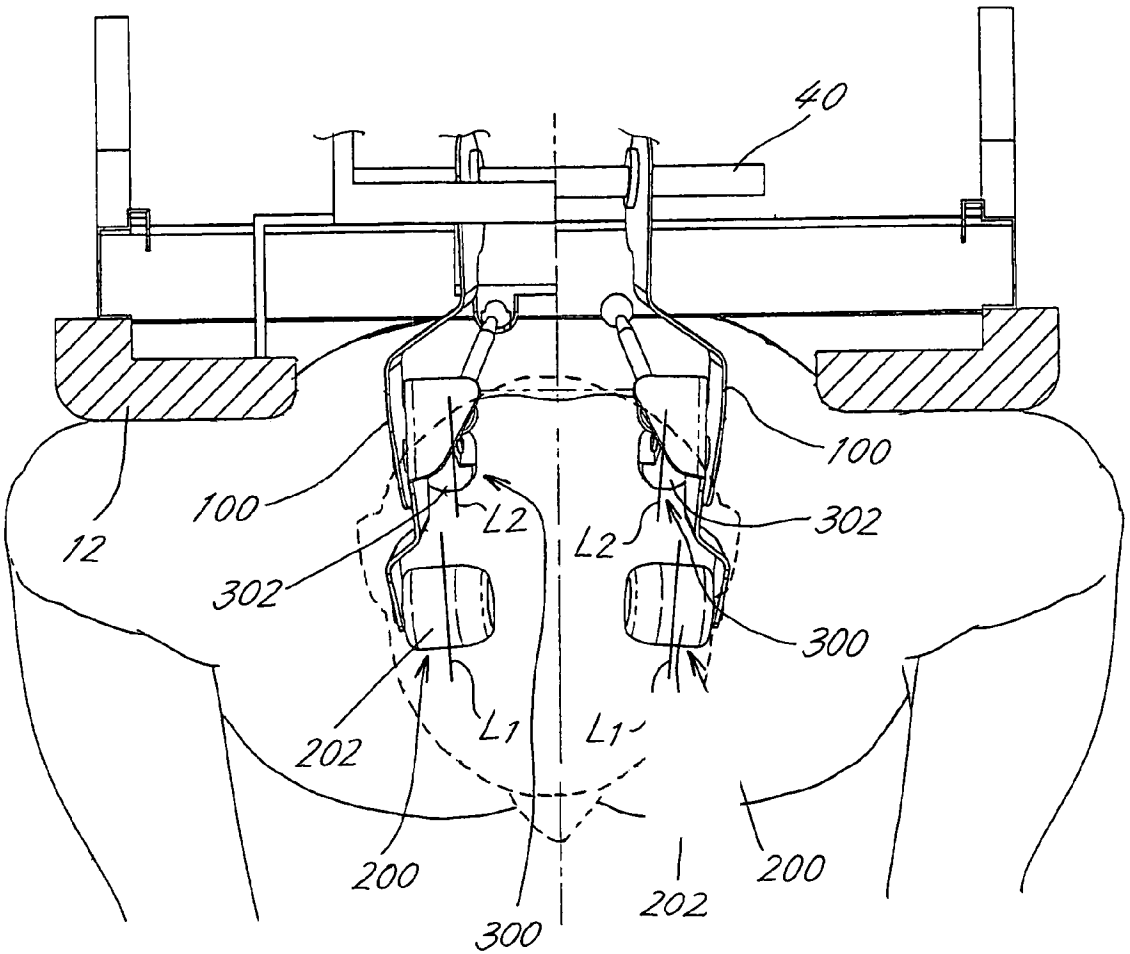
FIG. 16 is a plan view showing the opposed pair of pivotal levers of the first embodiment as they are moved toward each other.

According to the present embodiment, the sizes of the pressure elements 202, 302 and the range of lateral deflection of the pivotal levers 100 to be described later are so determined that the center L2 of width of the pressure element 302 of the second therapeutic member 300 at the lower level is positioned inwardly of the center L1 of width of the pressure element 202 of the first therapeutic member 200 at the upper level, when the free ends of the pivotal levers 100, 100 are moved away from each other to the greatest extent (at this time, the lever free ends are in the uppermost position) as shown in FIG. 15 and also when the lever free ends are moved toward each other to the greatest extent (the free ends are in the lowermost position at this time) as seen in FIG. 16. The kneading effect then produced by the pressure elements feels like that produced by the acupressurist since the thumb in the lower position is positioned inwardly of the center of width of the rows of the four fingers when the shoulder is kneaded by the acupressurist.

The first therapeutic members 200 are coupled to pivotal movement angle restricting means 401 for restricting the angular range of pivotal movement of each first therapeutic member 200 relative to the corresponding pivotal lever 100.

The restricting means 401 comprises a rod 402 pivotably connecting a rear upper end of the first pivotal lever 201 to the main chassis 21.

Ball portions provided at opposite ends of the rod 402 are rotatably and tiltably fitted in respective rod support portions 204, 82 provided on the first pivotal lever 201 and the main chassis 21, respectively, to provide universal joints.

Figure 14:
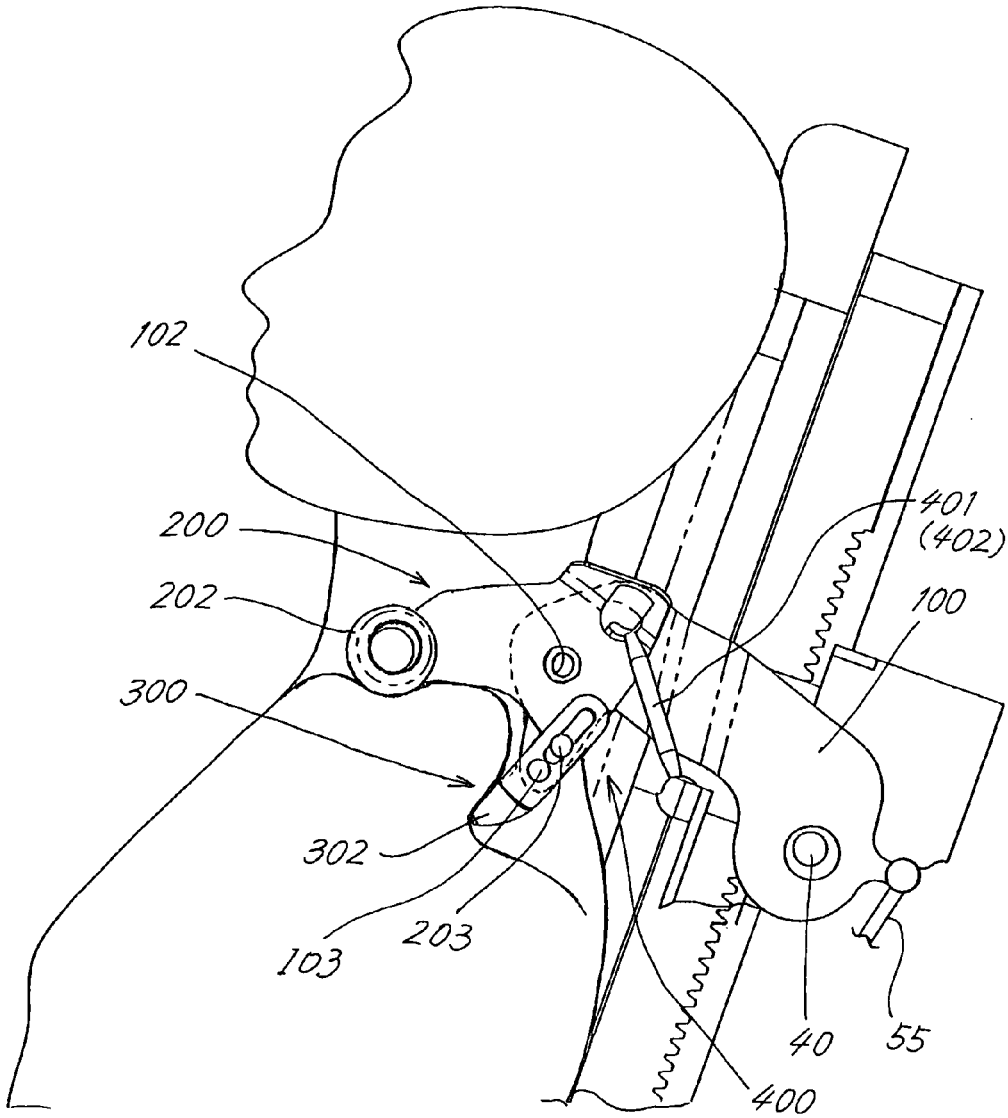
FIG. 14 is a side elevation showing the first and second therapeutic members of the first embodiment as they are moved toward each other.

When the free ends of the opposed pair of pivotal levers 100, 100 lower while reducing the spacing therebetween, each rod 402 props the first therapeutic member 200 to rotate the member 200 counterclockwise about the pivot 102 relative to the pivotal lever 100 as shown in FIG. 14. At this time, the pin 203 on the first therapeutic member 200 pushes the second therapeutic member 300, rotating the member 300 clockwise about the pin 103. In the state of FIG. 14, the pressure element 202 of the first therapeutic member 200 in the lowest position, the pressure element 302 of the second therapeutic member 300 is in the most advanced position, and the two pressure elements 202, 302 are spaced apart by a minimized distance. The minimized spacing is such that the shoulder muscle of the person to be massaged can be gripped suitably.

Figure 13:
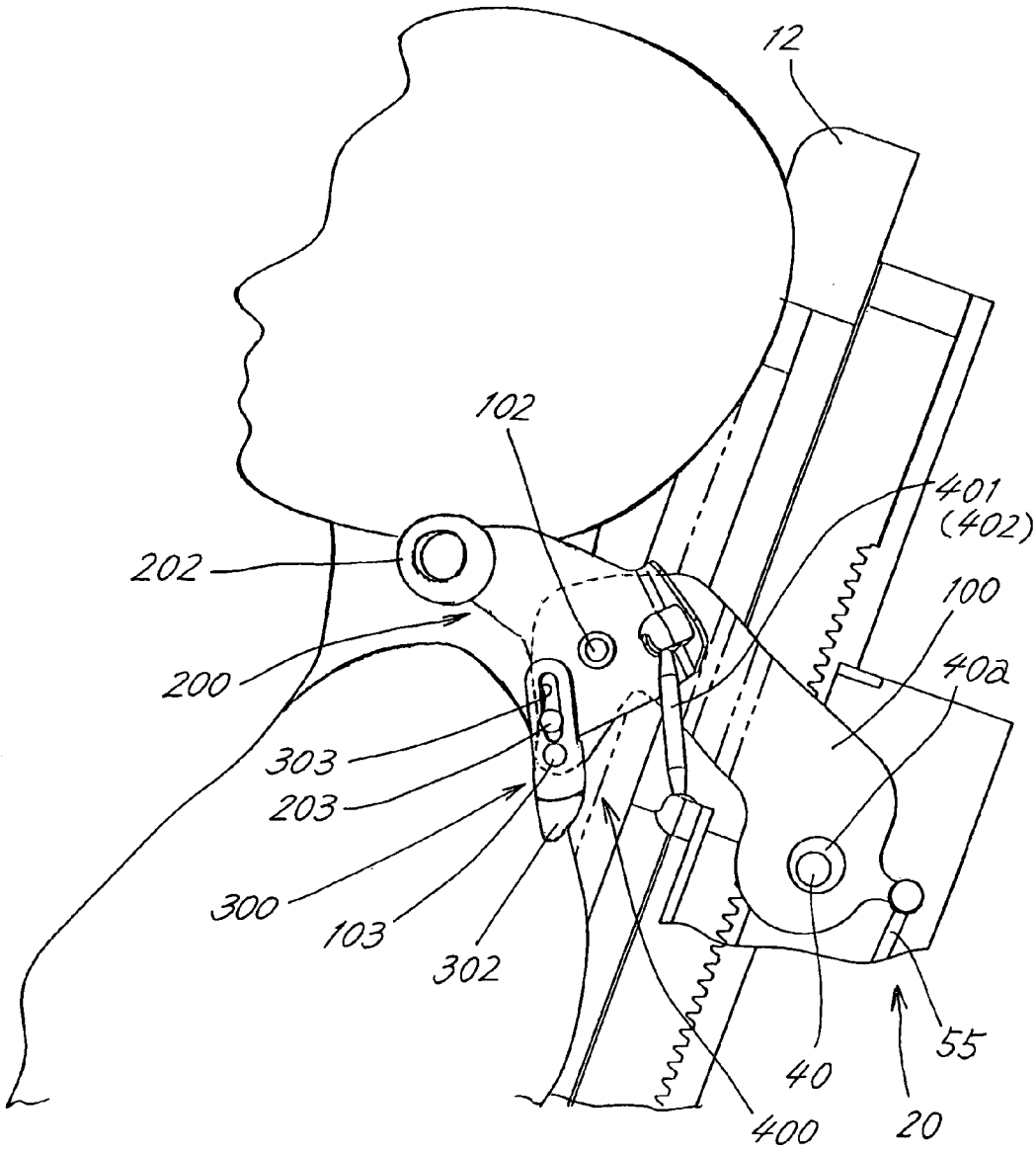
FIG. 13 is a side elevation showing the first therapeutic member and the second therapeutic member of a first embodiment as they are moved away from each other.

With reference to FIG. 13, when the opposed pair of pivotal levers 100, 100 rise while increasing the spacing between their free ends, the rod 402 pulls the first therapeutic member 200 rearward, rotating the member 200 clockwise about the pivot 102 relative to the pivotal lever 100. At this time, the pin 203 on the first therapeutic member 200 rotates the second therapeutic member 300 counterclockwise about the pin 103 by pushing the member 200. In the state of FIG. 13, the pressure element 202 of the first therapeutic member 200 is in the highest position, the pressure element 302 of the second therapeutic member 300 is in the most retracted position, and the two pressure elements 202, 302 are spaced apart by a maximum distance. The maximum spacing is such that the shoulder muscle of the person to be massaged can be released from the gripping elements smoothly.

The pivotal levers 100, 100 are eccentrically attached to the kneading shaft 40, as forwardly and laterally outwardly bent as described and are prevented from rotating by the rods 55, so that when the kneading shaft 40 is continuously rotated in one direction, the free ends of the pivotal levers 100, 100 are moved leftward and rightward, upward and downward, and forward and rearward. This movement also pivotally moves the first therapeutic members 200 and the second therapeutic members 300 leftward and rightward to knead the affected part of the person to be massaged in frictional contact therewith, in combination with the movement of the first and second members 200, 300 toward and away from each other.

When moved away from each other to the greatest extent as shown in FIG. 15, the pair of first therapeutic members 200, 200 are positioned on the shoulder to the neck of the person to be massaged, and when brought closest to each other as shown in FIG. 16, the pair of first therapeutic members 200, 200 can apply small pressure to the neck of the person.

The eccentric cams 53, 53 which are out of phase with each other by 180 degrees are supported on the tapping shaft 50 as seen in FIGS. 4 and 5, and the cams 53, 53 are connected to the rear ends, close to the shaft 40, of the pivotal levers 100, 100 by the universal joints 54, 54 and the rods 55, 55, respectively.

When the tapping shaft 51 is continuously rotated in one direction, the rods 55, 55 eccentrically connected to the tapping shaft cause the pivotal levers 100, 100 to move pivotally about the kneading shaft 40 as if greatly deflecting their forward ends and give a tapping massage mainly with the first therapeutic members 200. When the kneading shaft 40 and the tapping shaft 50 are rotated at the same time, the pivotal levers 100 repeatedly perform a reciprocating movement comprising forward-rearward strokes, upward-downward strokes and leftward-rightward strokes in combination.

[Pushing-Out Mechanism 60]

The massage unit 20 is provided with a pushing-out mechanism 60 for moving the unit 20 forward or rearward as shown in FIGS. 1 and 2. The pushing-out mechanism 60 comprises, for example, a crank mechanism 61 and a link mechanism 70 as will be described below.

Figure 6:
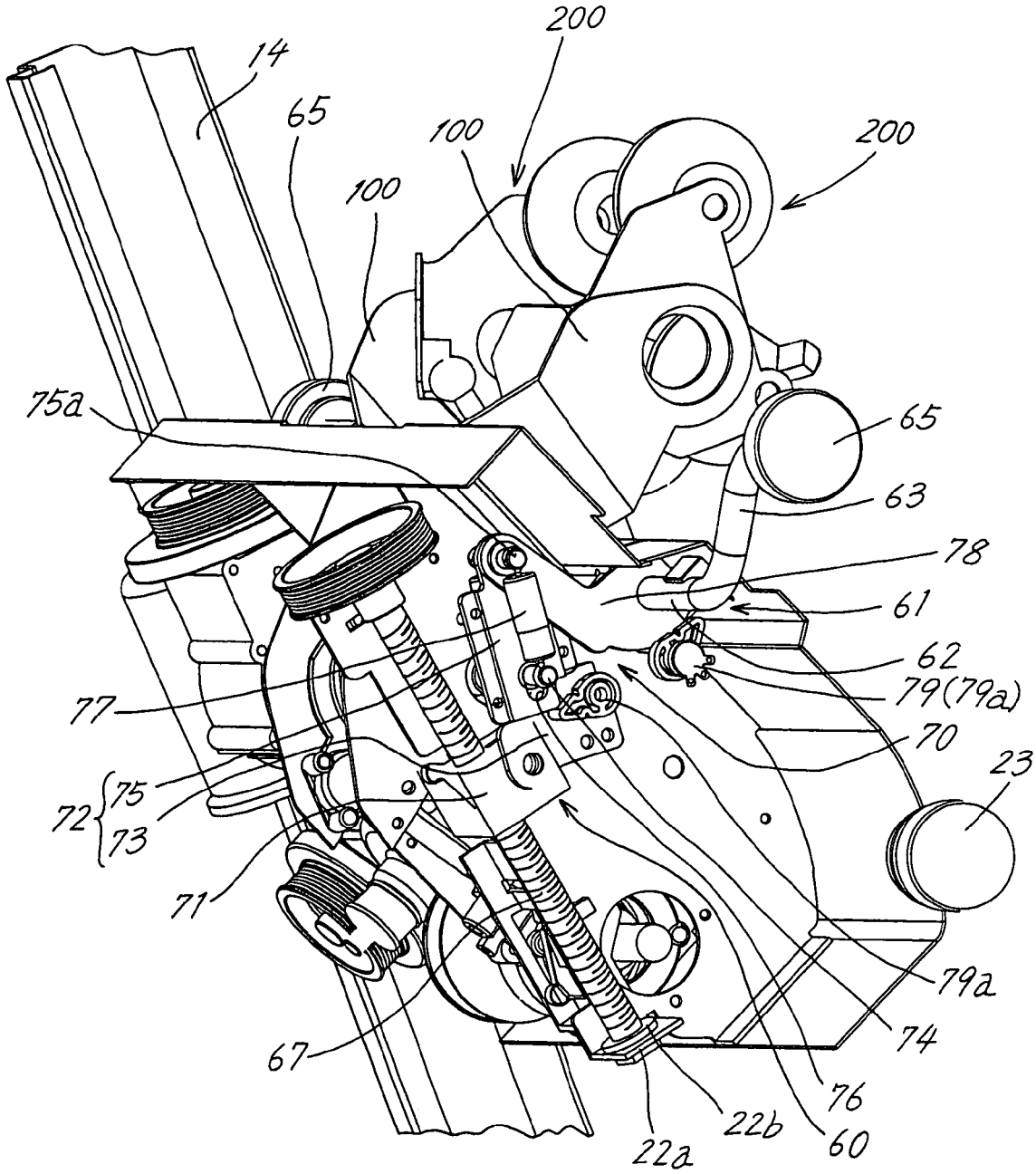
FIG. 6 is a perspective view of the massage unit as it is seen from obliquely leftwardly behind.

With reference to FIGS. 5 and 6, the crank mechanism 61 comprises a crankshaft 62 disposed in front of the kneading shaft 40, crank pins 64, 64 (see FIG. 5) having respective upper rollers 65, 65 (see FIG. 6) rotatably fitted there around, and crank arms 63, 63 connecting the crank pins 64, 64 to the crankshaft 62. The crank pins 64, 64 are eccentric relative to the crankshaft 62, so that when the crankshaft 62 is rotated, the crank pins 64, 64 revolve around the crankshaft 62. According to the illustrated embodiment, a single metal rod provides the crankshaft 62, crank arms 63, 63 and crank pins 64, 64. As shown in FIG. 5, the crankshaft 62 is supported by bearings 62*a*, 62*a* on the main chassis 21.

With reference to FIG. 3, the auxiliary chassis 22 is provided with upper and lower support pieces 22*a*, 22*a* each having a bearing 22*b*. As shown in FIGS. 3, 4 and 6, a pushing-out screw rod 67 is supported by the bearings 22*b*, 22*b*. The screw rod 67 has an upper end coupled to a pushing-out motor 69 by reduction means 68 comprising pulleys and a belt.

Figure 7:
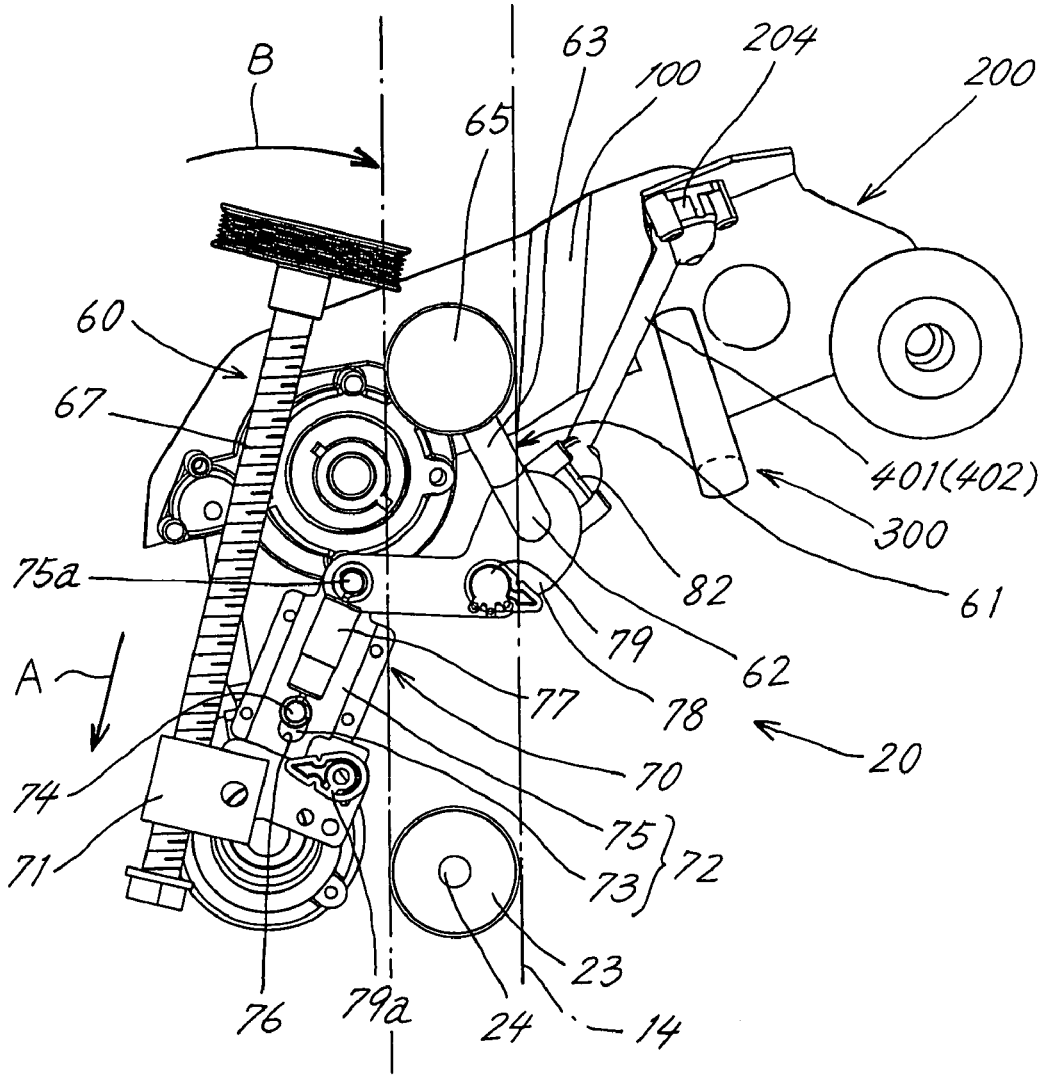
FIG. 7 is a fragmentary sectional view of the massage unit.

A nut 71 is screwed on the screw rod 67. The nut 71 can be made of a resin. The link mechanism 70 is connected to the resin nut 71 as shown in FIGS. 6 and 7. The link mechanism 70 can be composed of a link 72 and a link piece 78.

The link 72 to be described below comprises, for example, a first link piece 73 and a second link piece 75 which are slidable on each other so as to be stretchable or contractible longitudinally thereof.

The first link piece 73 is pivoted to the resin nut 71 so as to be tiltable forward or rearward. The first link piece 73 is provided in the vicinity of the base end thereof with a slide pin 74 projecting therefrom.

The second link piece 75 comprises a pair of members holding the first link piece 73 therebetween and each having a slit 76 elongated longitudinally thereof. The slide pin 74 of the first link piece 73 is slidably fitted in the slits 76 of the second link piece 75.

The second link piece 75 has a pin 75*a* projecting from an upper end thereof as shown in FIG. 6. A spring 77 extends between and is attached to the slide pin 74 and the pin 75*a* for biasing the second link piece 75 toward the resin nut 71. When free of any load, the second link piece 75 is held pulled toward the resin nut 71 to the greatest extent.

The link 78, i.e., the third link piece 78, is supported by the pin 75*a* of the second link piece 75. The third link piece 78 is bent forward at its midportion, has a forward end secured to the crankshaft 62 and is rotatable with the crankshaft 62.

When the resin nut 71 is positioned on an upper portion of the pushing-out screw rod 67, the third link piece 78 is pulled toward the second link piece 75, and the massage unit 20 (main chassis 21) is in the most retracted position (see FIGS. 1 and 6).

When the resin nut 71 in this state is moved down (in the direction of arrow A in FIG. 7) as shown in FIG. 7 by rotating the screw rod 67, the second link piece 75 pulls the pivot for the third link piece 78 downward with the downward movement of the resin nut 71, rotating the third link piece 78 about the crankshaft 62. Since the third crank piece 78 is secured to the crankshaft 62, the shaft 62 rotates with the third link piece 78.

The crank pins 64, 64 at opposite ends of the crankshaft 62 are movable only along the guide rails 14, 14 by the rollers 65, 65 and will not move forward or rearward, so that the rotation of the crankshaft 62 tilts the massage unit 20 about the rotating shaft 24. Since the rotating shaft 24 is provided below the massage unit 20, the pivotal levers 100, 100 including the first and second therapeutic members 200, 300 are pushed out forward by the tilting of the massage unit 20 (as indicated by the arrow B in FIG. 7) as shown in FIG. 2.

When the screw rod 67 is reversely rotated from the state of FIG. 2, the resin nut 71 moves toward the upper side, retracting the massage unit 20 in the opposite direction to the above and pulling back the pivotal levers 100 including the upper and lower therapeutic members 200, 300 inwardly of the backrest 12 (see FIG. 1). In this pulled-back state, only the pressure elements 202 of the first therapeutic members 200 are in position for pressing the person to be massaged on the backrest 12.

By adjusting the position of the resin nut 71 on the pushing-out screw rod 67 by rotating the rod 67, the amount of pushing-out of the massage unit 20 is adjustable.

The amount of pushing-out of the massage unit 20 can be detected by pushing-out amount detecting means 79, which is, for example, a variable resistor 79*a* provided in contact with the third link piece 78 for measuring variations in resistance value with the rotational angle of the third link piece 78.

Since the crankshaft 62 rotates with the third link piece 78, the detecting means 79 may be provided on the crankshaft 62.

[Control Means 90]

Figure 8:
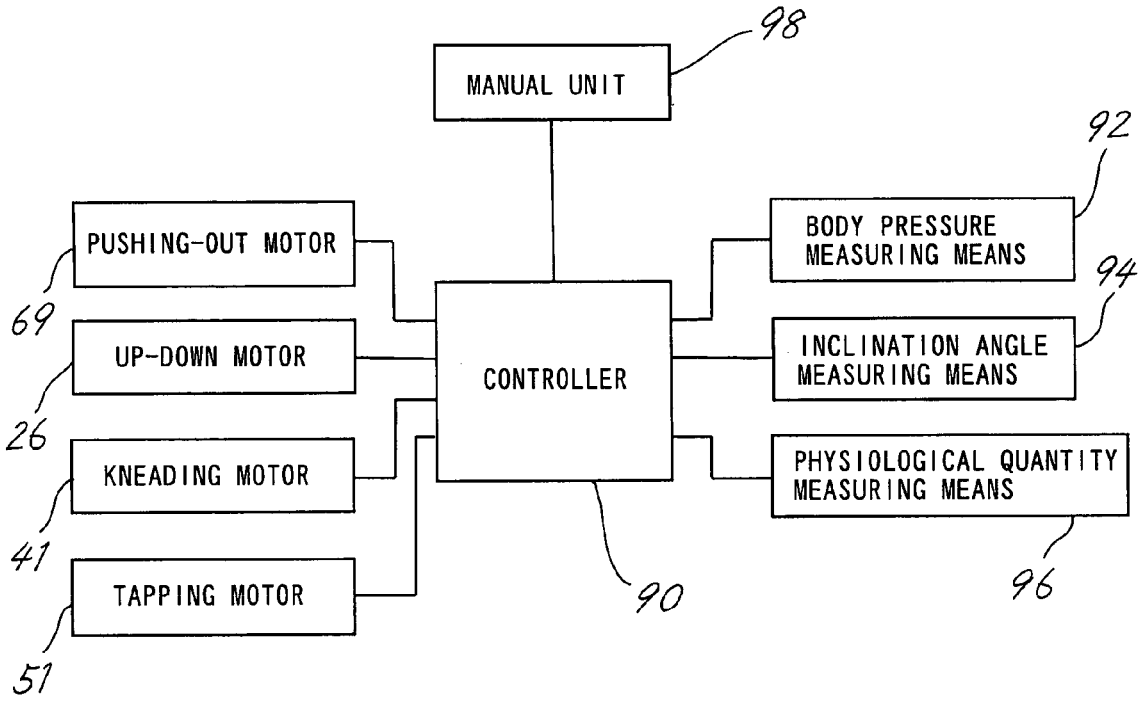
FIG. 8 is a block diagram of control means

The massage machine of the chair type is entirely controlled by control means 90 shown in FIG. 8. The control means 90 is provided in a suitable portion of the massage machine and has a drive circuit (not shown) for controlling the motors 26, 41, 51, 69, a memory having massage programs stored therein, etc. The massage movements to be described below are performed according to the programs stored in the control means 90.

[Massage Movements of Invention]

The amount of pushing-out of the massage unit 20 and the level thereof are so adjusted that the first therapeutic member 200 is positioned slightly above the shoulder of the person to be massaged, with the second therapeutic member 300 in contact with the back of the shoulder as shown in FIG. 13, when the massage unit 20 is pushed out forward from the backrest 12, with the pressure element 202 of each first therapeutic member 200 moved away from the pressure element 302 of the second therapeutic member 300 by the greatest distance.

The kneading motor 41 is driven in the above state to rotate the kneading shaft 40.

The two pivotal levers 100 are pivotally moved to move the free ends thereof upward and downward about the shaft 40 in combination with forward-rearward and leftward-rightward movements. While the first and second therapeutic members 200, 300 on each pivotal lever 100 pivotally move, the rod 402 serving as the motion conversion means 400 pulls the first therapeutic member 200 rearward, rotating the member 200 clockwise about the pivot 102 relative to the pivotal lever 100, when the free end of the lever 100 rises.

When the free end of the pivotal lever 100 moves down, the rod 402 props the first therapeutic member 200 forward, rotating the member 200 counterclockwise about the pivot 102 relative to the pivotal lever 100 as shown in FIG. 14.

When the free end of the pivotal lever 100 is in a raised position, the pressure element 202 of the first therapeutic member 200 is at a high level, the pressure element 302 of the second therapeutic member 300 is in a retracted position, and the pressure elements 202, 302 are spaced apart by the largest distance (see FIG. 13) as previously stated. When the free end of the pivotal lever 100 is in a lowered position, the pressure element 202 of the first therapeutic member 200 is in a low position, the pressure member 302 of the second therapeutic member 300 is in an advanced position, the spacing between the pressure elements 202, 302 is therefore minimized (see FIG. 14). Accordingly, one turn of rotation of the kneading shaft 40 moves the pressure element 202 on the shoulder and the pressure element 302 on the back of the shoulder toward each other and then moves them away from each other.

The muscle of the shoulder is gripped when the two pressure elements 202, 302 are moved toward each other, and is released from the gripping elements when the elements are moved away from each other. This movement resembles that of the acupressurist gripping and kneading the shoulder, producing a massage effect not available by the tapping movement or kneading movement of conventional massage machines.

According to the present embodiment, the center L2 of width of the pressure element 302 of the second therapeutic member 300 at the lower level is positioned inwardly of the center L1 of width of the pressure element 202 of the first therapeutic member 200 at the upper level, when the free ends of the opposed pair of pivotal levers 100, 100 are moved away from each other to the greatest extent as shown in FIG. 15 and also when the lever free ends are moved toward each other to the greatest extent as seen in FIG. 16 as previously described. Furthermore, the width of the upper pressure element 202 nearly corresponds to the width of the row of the first finger to the fourth finger, and the width of the lower pressure element 302 is approximately equal to the width of the thumb. For these reasons, the kneading movement of the pressure elements feels like the kneading action of the acupressurist on the shoulder, with the thumb at the lower level positioned inwardly of the center of width of the rows of the first to fourth fingers at the upper level.

According to the present embodiment, the free ends of the opposed pair of pivotal levers 100, 100 rise while increasing the spacing therebetween from the state wherein they are positioned closest (see FIG. 16), and lower while decreasing the spacing therebetween from the maximum spacing (see FIG. 15), with the result that the shoulder or the nape of the neck can be gripped from outside inward and kneaded by the pressure elements 202, 302 to give a massage effect that feels like that given by the hands of the acupressurist.

In practicing the present invention, the massage unit 20 can be provided with body pressure measuring means 92 for measuring the pressure to be given to the person to be massaged, by the pressure elements 202 of the first therapeutic members 200 so as to adjust the speed of movement of the first and second therapeutic members 200, 300 based on the pressure measurement obtained by the means 92.

For example in the construction described, the amount of slide of the second link piece 75 relative to the first link piece 73 corresponds to the force exerted on the first therapeutic member 200, so that the amount of slide may be measured as by the variable resistor 79*a* shown in FIG. 6 and serving as the body pressure measuring means 92. Upon the therapeutic members 200, 300 coming into contact with the shoulder of the person to be massaged, the first therapeutic member 200 is subjected to an upward force, with the result that the second link piece 75 slidingly moves upward against the biasing force of the spring 77. The amount of sliding movement of the second link piece 75 is detected by the variable resistor 79*a*, and the pressure of the first member 200 can be measured from the detected value.

For example if the pressure of the first therapeutic member 200 is great, the member 200 comes into contact with the person with a great pressure. The speed of rotation of the kneading motor 41 is therefore reduced for the first and second therapeutic members 200, 300 to slowly grip and knead the muscle. Conversely if the pressure of the first member 200 is small, the member comes into contact with the person with a small pressure, so that it is effective to increase the rotational speed of the kneading motor 41.

The massage unit 20 is further provided with physiological quantity measuring means 96 for measuring variations in a physiological quantity during massage. The speed of movement of the pivotal lever 100, i.e., of the first and second therapeutic members 200, 300 may be adjusted based on the physiological quantity measured. Examples of physiological quantities are heart rate, respiration rate, electrodermal resistance variation, etc., which can be measured by known means.

For example when the person to be massaged is found to be at ease by measuring a physiological quantity, the pivotal levers 100 are pivotally moved at a high speed, rapidly moving each first therapeutic member 200 and the second therapeutic member 300 toward and away from each other. If the person is found to be in a state of tension, the pivotal levers 100 are moved at a low speed, slowly moving the first therapeutic member 200 and the second therapeutic member 300 toward and away from each other.

Further a manual unit 98 (see FIG. 8) for use by the person to be massaged to manipulate the chair-type massage machine may be provided with buttons for manually varying the rotational speed of the kneading motor 41 or tapping motor 51. The person then manually varies the gripping speed of the therapeutic members 200, 300 as desired using the button.

According to the present embodiment, the pivotal levers 100, 100 are moved toward each other (see FIG. 16) and away from each other (see FIG. 15) every time the kneading shaft 40 rotates one turn during the above operation. The machine therefore gives a massage by rubbing the shoulders laterally and nipping the neck on opposite sides thereof, in addition to gripping and kneading.

While gripping the affected part by minimizing the spacing between the pressure element 202 of the first therapeutic member 200 and the pressure element 302 of the second therapeutic member 300, the kneading motor 41 is held out of operation, and the up-down motor 26 is driven to raise the massage unit 20 by 2 to 3 cm. The up-down motor 26 is then stopped, and the kneading motor 41 is started again 2 to 3 seconds later to increase the spacing between the pressure elements 202, 302 and release the affected part from the gripping elements. The up-down motor 26 is subsequently rotated reversely to lower the massage unit 20 to the original position. Repetition of this movement repeatedly grips the affected part to realize a more effective gripping massage.

[Additional Tapping Massage]

With the pressure elements 202 of the first therapeutic members 202 only in condition for pressing the person to be massaged by accommodating the massage unit 20 inside the backrest 12, the level of the massage unit 20 is adjusted by the up-down motor 26 so that the pressure elements 202 will be positioned for the affected part of the back or the waist of the person to be massaged. The tapping shaft 50 is rotated by driving the tapping motor 51. Since the rear ends of the pivotal levers 100 are pivotably connected by rods 55 to the eccentric cams 53, 53 on the tapping shaft 50, the pivotal levers 100 move forward and rearward once every time the shaft 50 rotates one turn. This gives a tapping massage to the back of the person.

By moving the massage unit 20 upward and downward by the up-down motor 26, a rolling massage can be applied with the pressure elements 202 pressed against the person with a great force.

Both the pressure elements 202, 302 of the first and second therapeutic members 200, 300 may of course be brought into contact with the back of the person at the same time, with the pressure element 302 of the second member 300 modified into a gently shaped roller having no corners like the flat roller 202*a* shown in FIG. 3.

The gripping-kneading movement described may be added to the above movement by rotating the kneading shaft 40.

Figure 17:
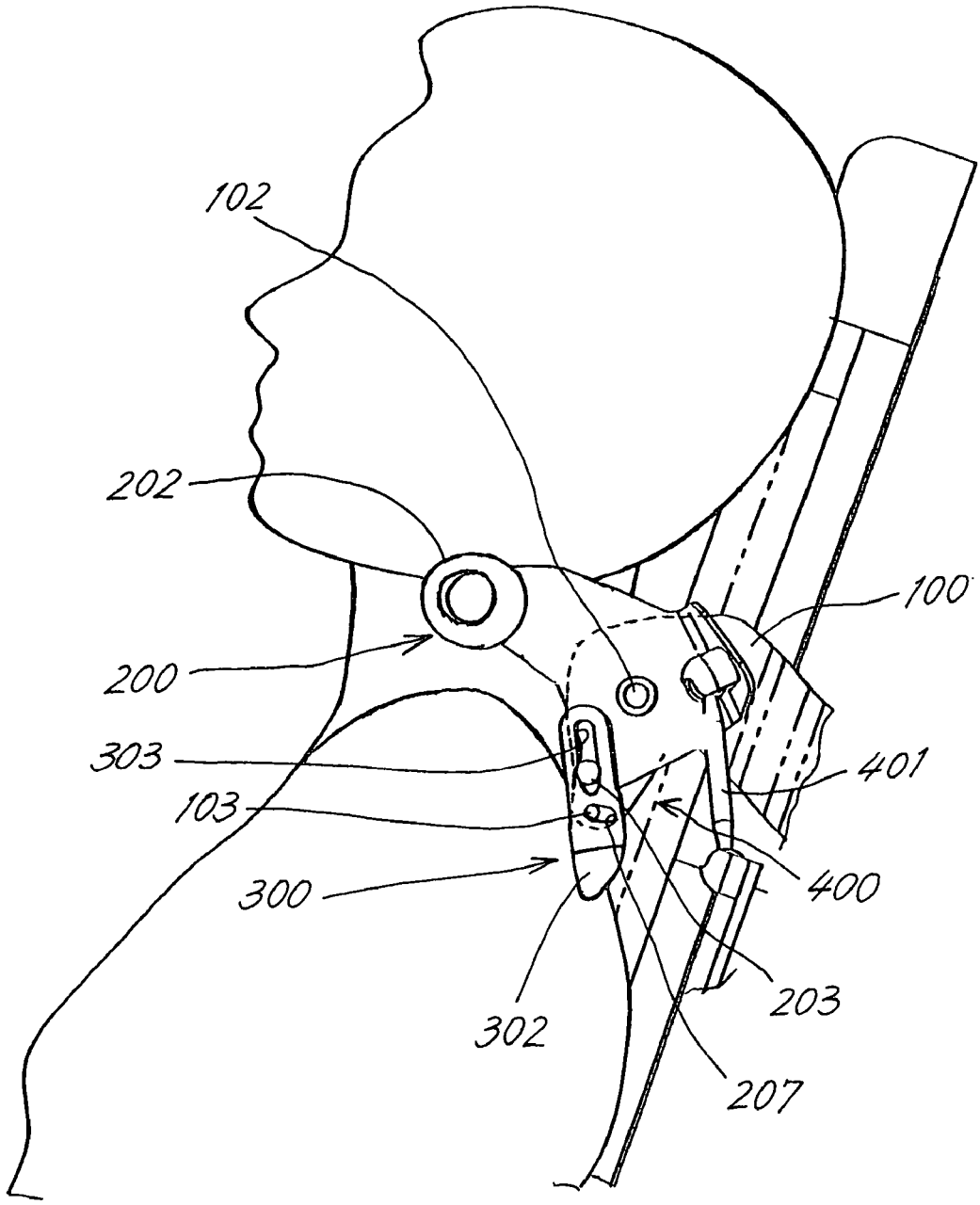
FIG. 17 is a side elevation showing a first therapeutic member and a second therapeutic member of a second embodiment as they are moved away from each other.
Figure 18:
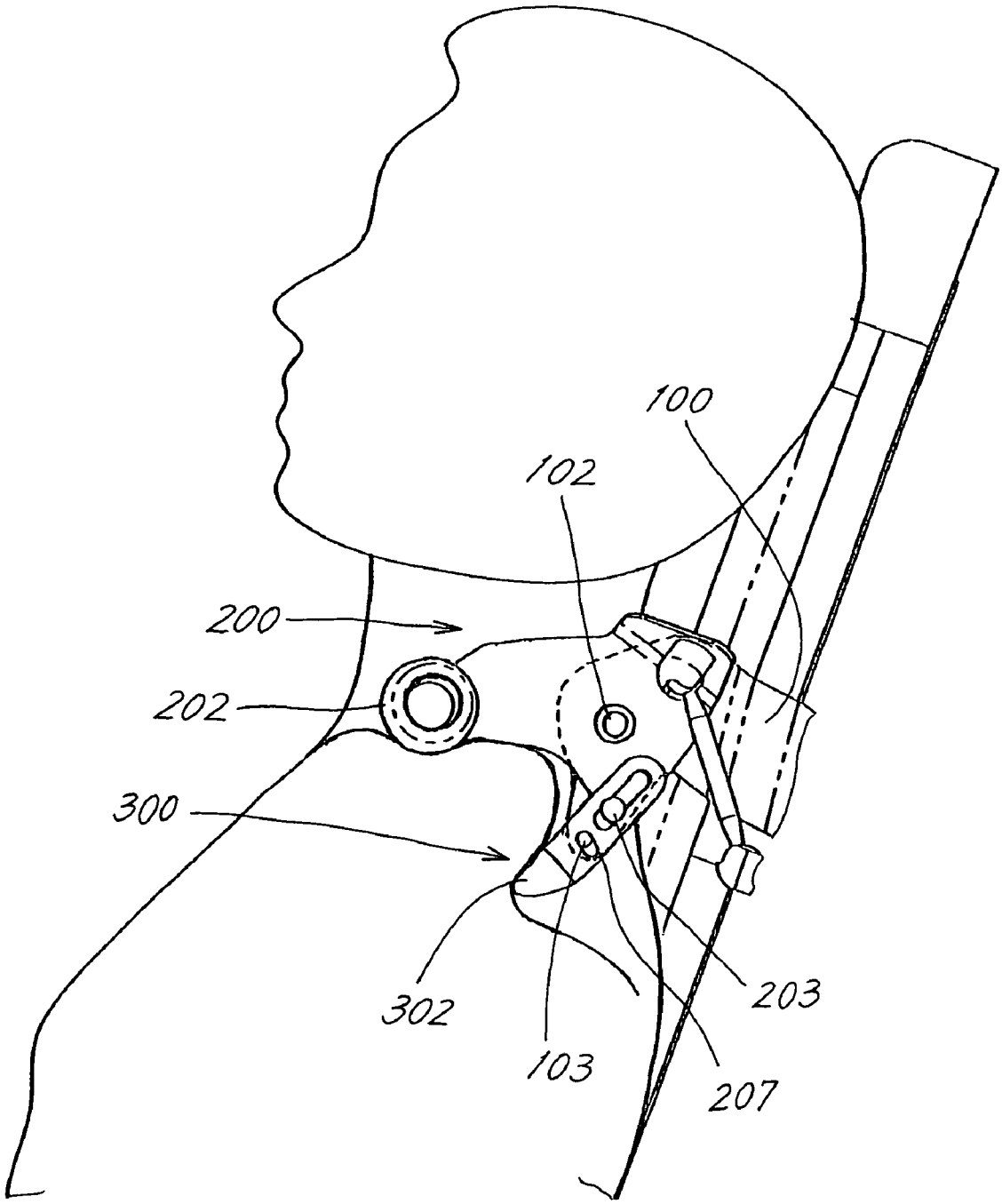
FIG. 18 is a side elevation showing the first and second therapeutic members of the same embodiment as they are moved toward each other.

Second Embodiment for Attaching Therapeutic Member (FIGS. 17 and 18)

The first therapeutic member 200 is movably supported by the pivot 102 on the free end of each pivotal lever 100 which is pivotally movable by the same mechanism as already described and the angular range of pivotal movement of which is restricted by the same mechanism. This is also true of third to fifth embodiments to follow.

A second therapeutic member 300 in the form of a bar has a short slit 207 formed approximately in the midportion thereof and orthogonal to the length of the member 300. A pin 103 provided on a front lower portion of the pivotal lever 100 is slidably fitted in the slit 207 to support the member 300 as positioned vertically. A pin 203 on the first therapeutic member 200 is slidably fitted in an elongated hole 303 in the second member 300.

FIG. 17 shows the pressure element 202 on the first therapeutic member 200 and the pressure element 302 on the second therapeutic member 300 as moved away from each other to the greatest extent to release the shoulder of the person to be massaged from the gripping elements. FIG. 18 shows the pressure elements 202, 302 as moved toward each other to the greatest extent to grip the shoulder.

This embodiment differs from the first embodiment shown in FIG. 13 in that the pin 103 on the pivotal lever 100 renders the second therapeutic member 300 rotatable and supports the member 300 loosely with forward or rearward play corresponding to the length of the slit 207. The second therapeutic member comes into contact with the affected part gently by virtue of this difference.

Figure 19:
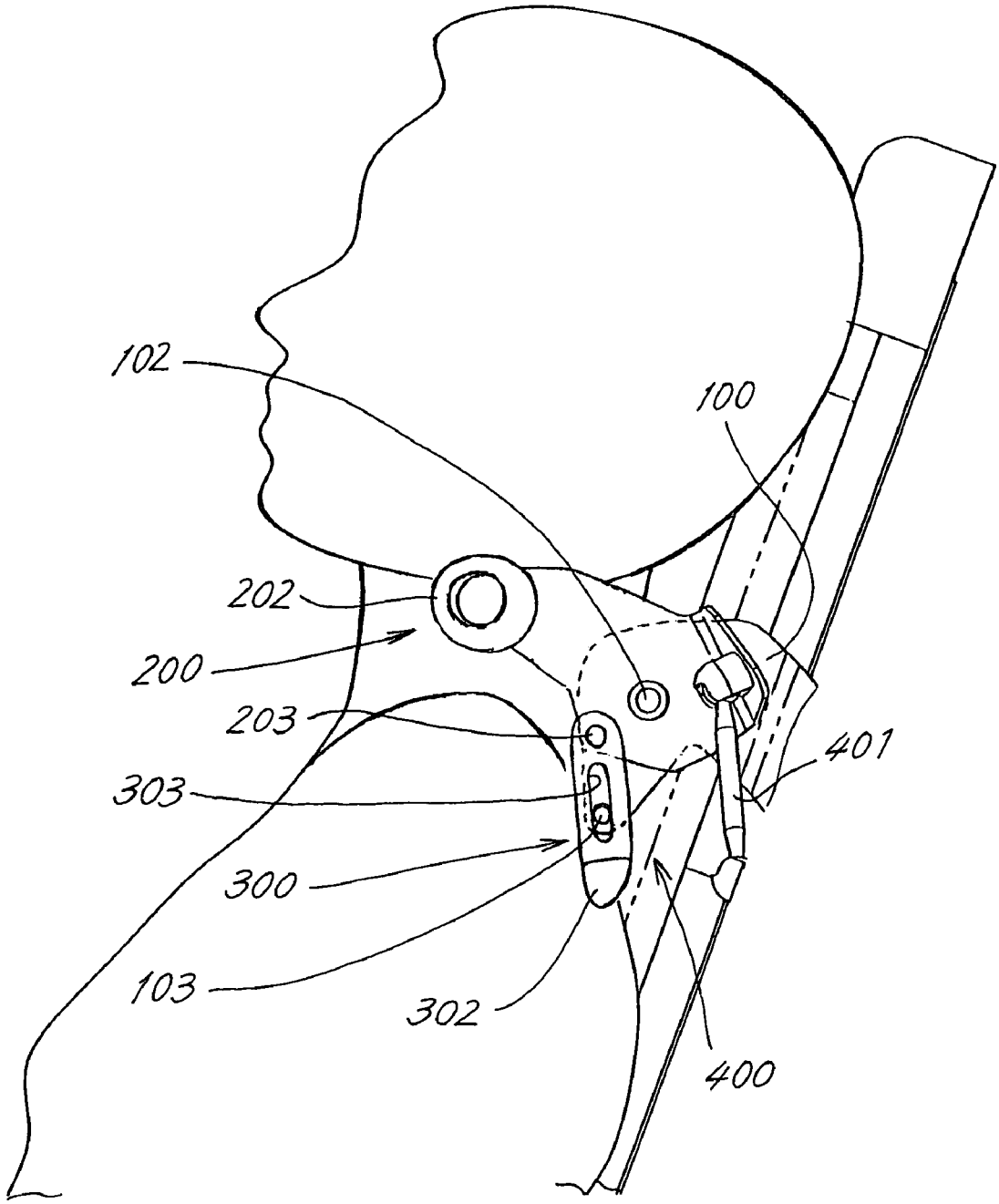
FIG. 19 is a side elevation showing a first therapeutic member and a second therapeutic member of a third embodiment as they are moved away from each other.
Figure 20:
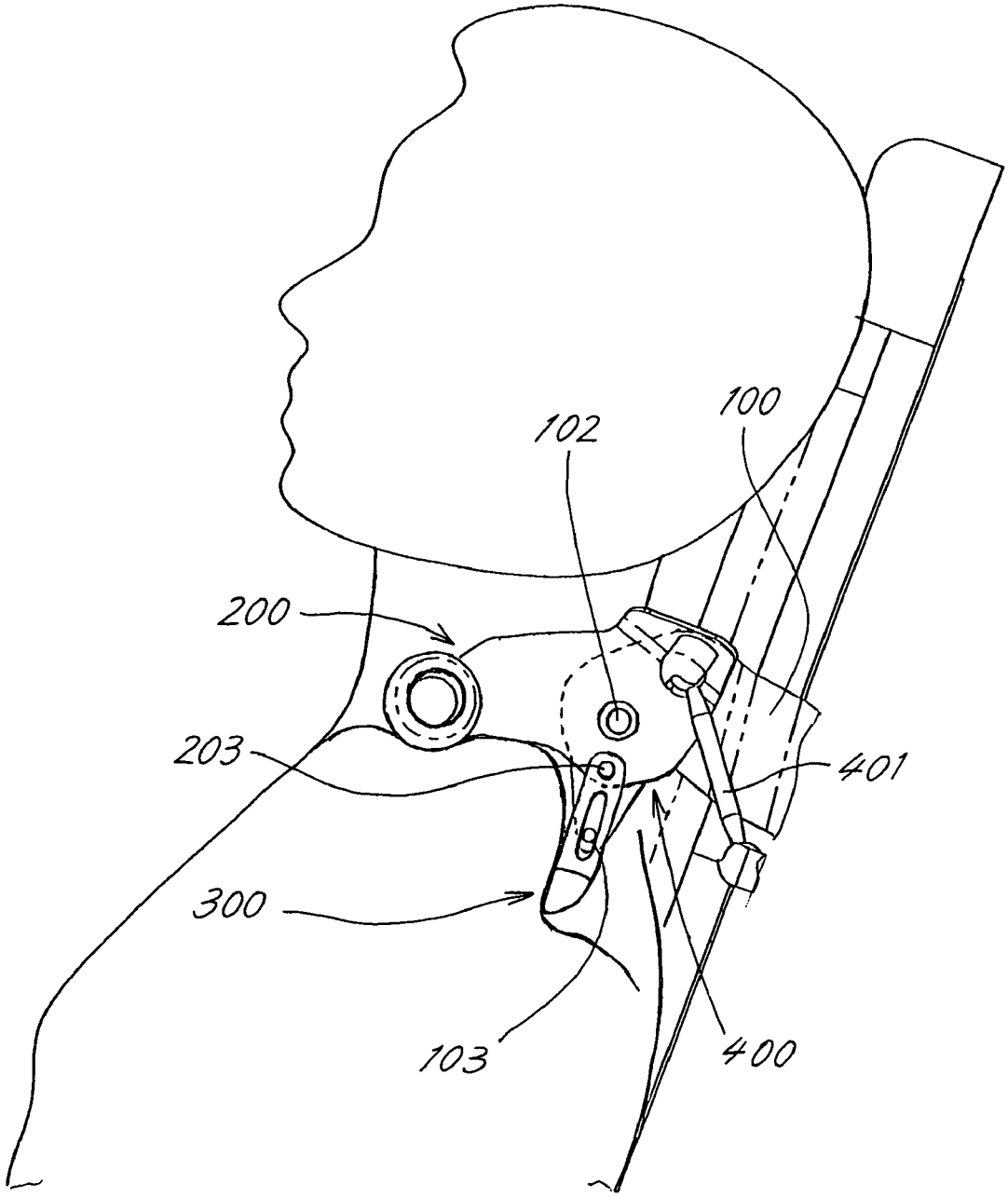
FIG. 20 is a side elevation showing the first and second therapeutic members of the same embodiment as they are moved toward each other.

Third Embodiment for Attaching Therapeutic Member (FIGS. 19 and 20)

A pin 103 on the pivotal lever 100 is slidably fitted in an elongated hole 303 formed approximately in the midportion of a second therapeutic member 300 and extending longitudinally of the member 300. The second member 300 is pivoted to the first therapeutic member 200 by a pin 203.

When the free end of the pivotal lever 100 rises, the first therapeutic member 200 rotates about the pivot 102 clockwise relative to the lever 100 in the same manner as already described. At this time, the pin 203 on the first member 200 rotates the second member 300 about the pin 103 on the lever 100 counterclockwise. In this state, the pressure element 202 of the first member 200 is in the highest position, and the pressure member 302 of the second member 300 is retracted to the greatest extent, with a maximum spacing provided between the two pressure elements 202, 302 (see FIG. 19).

When the free end of the pivotal lever 100 lowers, the first member 200 rotates about the pivot 102 counterclockwise relative to the lever 100 as previously described. The counterclockwise rotation of the first member 200 causes the pin 203 on the member 200 to rotate the second member 300 about the pin 103 clockwise. In this state, the pressure element 202 of the first member 200 is in the lowest position, the pressure element 302 of the second member 300 is in the most advanced position, and the spacing between the two pressure elements 202, 302 is minimum (see FIG. 20).

Figure 21:
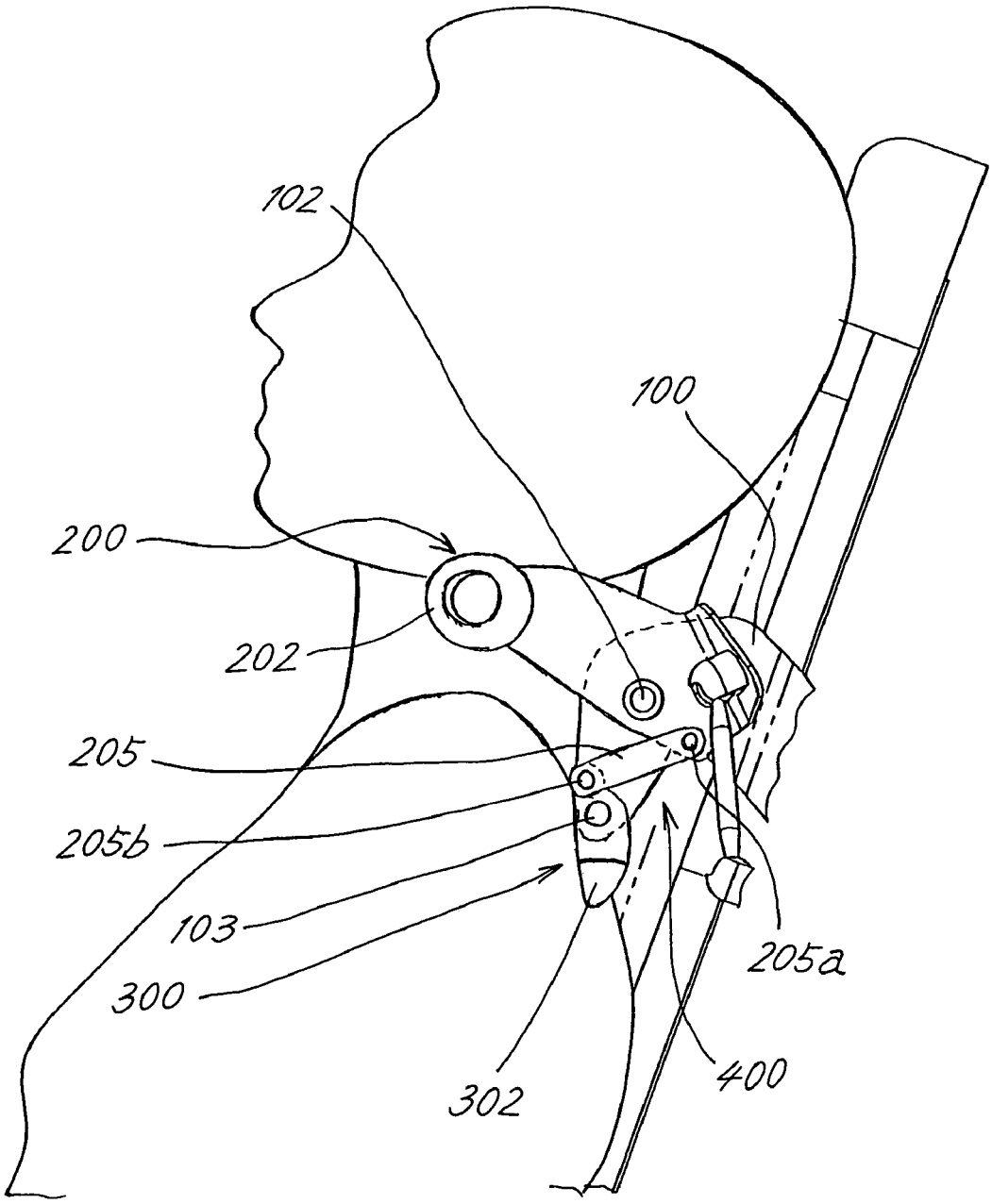
FIG. 21 is a side elevation showing a first therapeutic member and a second therapeutic member of a fourth embodiment as they are moved away from each other.
Figure 22:
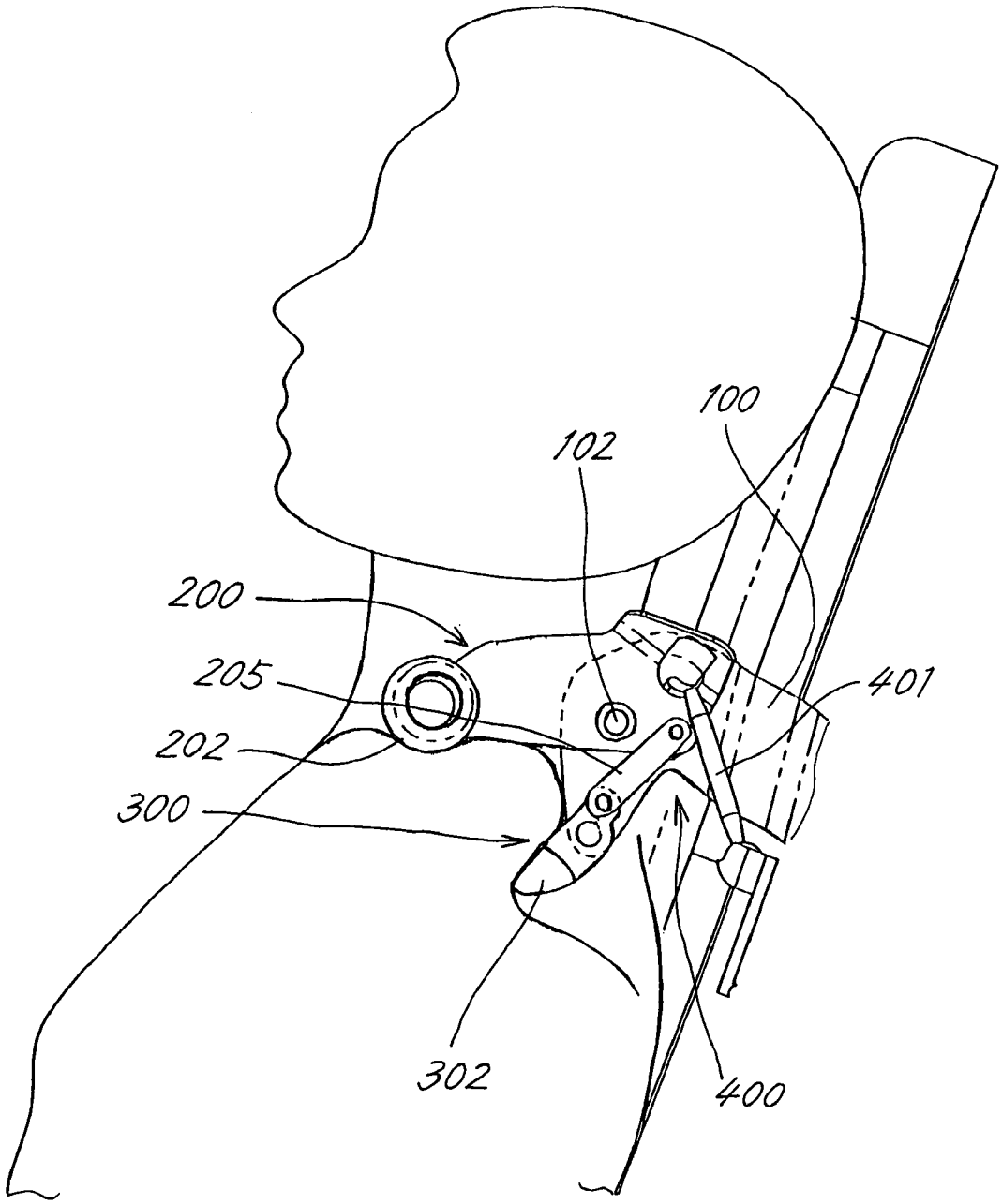
FIG. 22 is a side elevation showing the first and second therapeutic members of the same embodiment as they are toward each other.

Fourth Embodiment for Attaching Therapeutic Member (FIGS. 21 and 22)

A second therapeutic member 300 is rotatably supported in a vertical position by a pin 103 on a free end lower portion of the pivotal lever 100.

The first therapeutic member 200 is pivotably connected to the second member 300 by a link 205. The pivot 205*a* for the link 205 on the first member 200 is positioned in the rear of the pivot 102 for supporting the first member 200, and the pivot 205*b* for the link 205 on the second member 300 is positioned above and close to the pin 103 for supporting the second member 300.

When the free end of the pivotal lever 100 rises, the first therapeutic member 200 rotates about the pivot 102 clockwise relative to the lever 100 in the same manner as already described. The rotation causes the link 205 to push the second member 300 into counterclockwise rotation about the pin 103 on the pivotal lever 100. In this state, the pressure element 202 of the first member 200 is in the highest position, the pressure element 302 of the second member 300 is in the most retracted position, and the spacing between the two pressure elements 202, 302 is maximum (see FIG. 21).

When the free end of the pivotal lever 100 lowers, the first member 200 rotates about the pivot 102 counterclockwise relative to the lever 100 as previously described. The rotation causes the link 205 to pull the second member 300, moving the second member 300 about the pin 103 on the lever 100 clockwise. In this state, the pressure element 202 of the first member 200 is in the lowest position, the pressure element 302 of the second member 300 is in the most advanced position, and the spacing between the two pressure elements 202, 302 is minimum (see FIG. 22).

Figure 23:
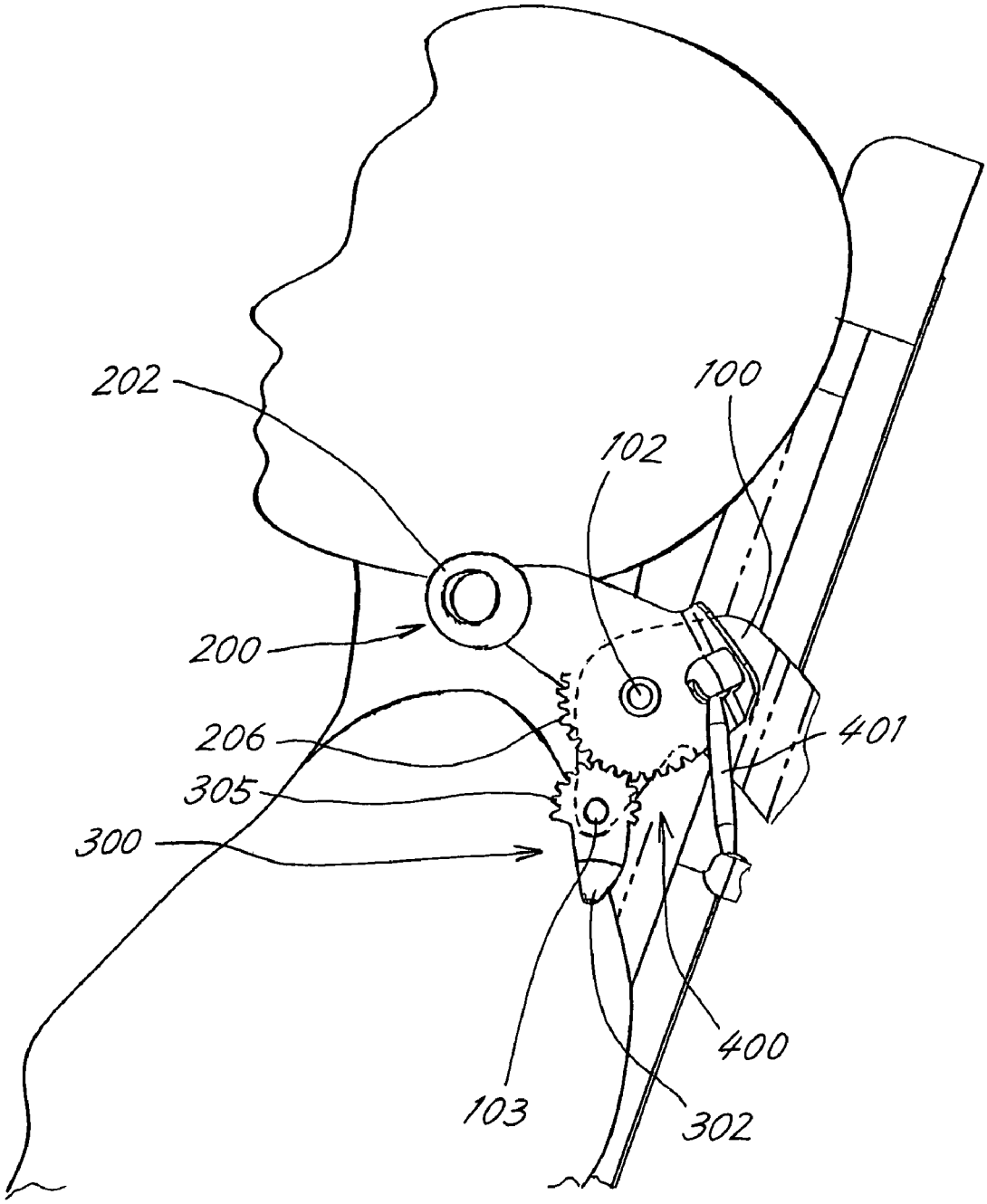
FIG. 23 is a side elevation showing a first therapeutic member and a second therapeutic member of a fifth embodiment as they are moved away from each other.

Fifth Embodiment for Attaching Therapeutic Member (FIG. 23)

A second therapeutic member 300 is rotatably supported in a vertical position by a pin 103 on a free end lower portion of the pivotal lever 100.

The first therapeutic member 200 and the second therapeutic member 300 are provided with circular-arc gear portions 206, 305 which are centered about the respective centers of rotation of the members 200, 300 and which are in mesh with each other so as to rotate in opposite directions to each other.

When the free end of the pivotal lever 100 rises, the first therapeutic member 200 rotates about the pivot 102 clockwise relative to the lever 100 in the same manner as already described. This rotation rotates the second therapeutic member 300 counterclockwise in meshing engagement with the first member 200. In this state, the pressure element 202 of the first member 200 is in the highest position, the pressure element 302 of the second member 300 is in the most retracted position, and the spacing between the two pressure elements 202, 302 is maximum.

When the free end of the pivotal lever 100 lowers, the first member 200 rotates about the pivot 102 counterclockwise relative to the lever 100 as previously described. The rotation rotates the second member 300 clockwise in meshing engagement with the first member 200. In this state, the pressure element 202 of the first member 200 is in the lowest position, the pressure element 302 of the second member 300 is in the most advanced position, and the spacing between the two pressure elements 202, 302 is minimum.

With the foregoing embodiments, the output shaft portions 40*a*, 40*a* having the base ends of the pivotal levers 100, 100 rotatably fitted there around are inclined in opposite directions to each other on the kneading shaft 40 and are eccentric to cause the rotation of the kneading shaft 40 to pivotally move the levers 100, 100 upward, downward, forward, rearward, leftward and rightward and to thereby move the first and second therapeutic members 200, 300 toward and away from each other.

However, the output shaft portions 40*a*, 40*a* need not always be eccentric but may merely be inclined.

In this case, the pivotal levers 100 pivotally move leftward and rightward, and when the spacing between the levers 100, 100 increases, the spacing between the first and second therapeutic members 200, 300 increases as shown in FIG. 13. When the spacing between the two pivotal levers 100, 100 decreases, the spacing between the two therapeutic members 200, 300 reduces as shown in FIG. 14. Conversely, the output shaft portions 40*a*, 40*a* may merely be made eccentric without being inclined. The pivotal levers 100 then move upward, downward, forward and rearward. When the levers 100 pivotally move upward and rearward, the spacing between the two therapeutic members 200, 300 increases as shown in FIG. 13. When the levers pivotally move downward and forward, the spacing between the two members 200, 300 decreases as shown in FIG. 14.

According to the foregoing embodiments, the first and the second therapeutic members 200, 300 move toward and away from each other by merely moving the massage unit 20 forward and rearward by the pushing-out motor 69.

When the massage unit 20 is in a rearward position as shown in FIG. 1, the first and second therapeutic members 200, 300 are spaced apart by a large distance, while when the massage unit 20 is in a forwardly pushed-out position as shown in FIG. 2, the spacing between the two members 200, 300 is small.

To sum up the invention, the second therapeutic member 300 need only to move toward and away from the first therapeutic member 200 in operative relation with the pivotal movement of the first member 200. The first therapeutic member may be moved by a motor specific thereto.

A gripping massage involving more complex movements can be realized by driving the kneading motor 41 and the pushing-out motor 69 at the same time, or further driving these motors and the up-down motor 26 at the same time.

Although the first and the second therapeutic members 200, 300 are pivotally moved by the pivotal movement of the pivotal lever 100, the pivotal lever 100 can be dispensed with. In this case, the first therapeutic member 200 is pivotably mounted on the chassis 21, with a motor or like drive means coupled to the first member 200 to replace the pivotal lever 100 of the embodiments by the chassis 21, and the first and second therapeutic members 200, 300 are coupled by a mechanism for making these members 200, 300 cooperative to grip and knead the affected part of the person to be massaged.

Apparently, the present invention can be altered or modified by one skilled in the art without departing from the spirit of the invention, and such modifications are included within the scope of the invention as set forth in the appended claims.

The invention claimed is:

1. A massage unit comprising a pair of left and right pivotal levers pivotally movably arranged on a chassis, and a first therapeutic member and a second therapeutic member arranged on each of the pivotal levers and movable toward and away from each other so as to grip and knead an affected part of the person to be massaged, the first therapeutic member and the second therapeutic member having motion conversion means coupled thereto for converting the pivotal movement of the pivotal lever into the movement of the first therapeutic member and the second therapeutic member toward and away from each other, wherein the first therapeutic member and the second therapeutic member are pivotally movably supported on the pivotal lever toward a free end thereof, and the angle of pivotal movement of the first therapeutic member relative to the pivotal lever is restricted by pivotal movement angle restricting means, a pin provided on the first therapeutic member being slidably fitted in an elongated hole formed in the second therapeutic member to provide the motion conversion means.

2. The massage unit according to claim 1 wherein a kneading shaft is rotatably mounted on the chassis and has two output shaft portions inclined in opposite directions to each other relative to an axis of the shaft, the pair of pivotal levers being rotatably supported at base ends thereof by the respective output shaft portions of the kneading shaft, the first therapeutic member being pivotably connected to the chassis by a rod having universal joints at respective opposite ends thereof and serving as the pivotal movement angle restricting means, the first therapeutic member and the second therapeutic member at each of left and right sides being movable toward and away from each other by the rotation of the kneading shaft.

3. The massage unit according to claim 1 wherein a kneading shaft is rotatably mounted on the chassis and has two output shaft portions eccentric relative to an axis of the shaft, the pair of pivotal levers being rotatably supported at base ends thereof by the respective output shaft portions of the kneading shaft, the first therapeutic member being pivotably connected to the chassis by a rod having universal joints at respective opposite ends thereof and serving as the pivotal movement angle restricting means, the first therapeutic member and the second therapeutic member on each pivotal lever being movable toward and away from each by the rotation of the kneading shaft.

* * * * *